US008376214B2

(12) United States Patent
Spivey, Sr. et al.

(10) Patent No.: US 8,376,214 B2
(45) Date of Patent: Feb. 19, 2013

(54) CARTON WITH INSERT

(75) Inventors: Raymond R. Spivey, Sr., Mableton, GA (US); Jean-Manuel Gomes, Marietta, GA (US); Andrew John Woolford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 276 days.

(21) Appl. No.: 12/836,314

(22) Filed: Jul. 14, 2010

(65) Prior Publication Data

US 2011/0011924 A1 Jan. 20, 2011

Related U.S. Application Data

(60) Provisional application No. 61/270,857, filed on Jul. 14, 2009, provisional application No. 61/277,969, filed on Oct. 1, 2009.

(51) Int. Cl.
*B65D 5/54* (2006.01)
*B65D 5/42* (2006.01)
*B31B 17/00* (2006.01)

(52) U.S. Cl. ..... 229/200; 229/199; 493/84

(58) Field of Classification Search ..... 229/200, 229/307; 493/84; 206/433, 435
See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilsom |
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |
| 3,133,634 | A | 5/1964 | Bozdar |
| 3,173,596 | A | 3/1965 | Aust et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |
| 3,346,167 | A | 10/1967 | Schmidt |

(Continued)

FOREIGN PATENT DOCUMENTS

| | | | |
|---|---|---|---|
| CA | 873185 | A1 | 6/1971 |
| DE | 298 15 677 | U1 | 11/1998 |

(Continued)

OTHER PUBLICATIONS

International Search Report and Written Opinion for PCT/US2010/041971, dated Mar. 1, 2011.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for containing a plurality of articles. The carton has panels that extend at least partially around an interior of the carton. The panels comprise a top panel, a bottom panel, a first side panel, and a second side panel. The carton comprises an insert attached to at least one of the panels for restraining the articles in the carton.

36 Claims, 23 Drawing Sheets

U.S. PATENT DOCUMENTS 3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A 9/1975 Forrer
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A 12/1991 Wilson
5,101,642 A 4/1992 Alexandrov
5,119,985 A 6/1992 Dawson et al.
5,137,211 A 8/1992 Summer et al.
5,219,229 A 6/1993 Sengewald
5,249,681 A 10/1993 Miller
5,297,725 A 3/1994 Sutherland
5,320,277 A 6/1994 Stout et al.
5,333,734 A 8/1994 Stout et al.
5,350,109 A 9/1994 Brown et al.
5,425,474 A 6/1995 Dalea et al.
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 10/2001 Stout
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland et al.
7,225,930 B2 6/2007 Ford et al.
7,422,104 B2 9/2008 Perkinson
7,478,743 B2 1/2009 Holley, Jr.
7,604,157 B2 10/2009 Zammit et al.
7,699,215 B2 4/2010 Spivey, Sr.
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates
2003/0150759 A1 8/2003 White, Jr.
2003/0192907 A1 10/2003 Bates
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0126947 A1 6/2005 Holley, Jr.
2005/0167291 A1 8/2005 Sutherland
2005/0167478 A1 8/2005 Holley et al.
2005/0189405 A1 9/2005 Gomes et al.
2005/0263574 A1 12/2005 Schuster
2006/0054522 A1 3/2006 Kline et al.
2006/0081691 A1 4/2006 Smalley
2006/0091193 A1 5/2006 DeBusk
2006/0118606 A1 6/2006 Holley, Jr. et al.
2006/0131370 A1 6/2006 Bates
2006/0175386 A1 8/2006 Holley, Jr.
2006/0231441 A1 10/2006 Gomes et al.
2006/0231600 A1 10/2006 Holley, Jr.
2006/0249413 A1 11/2006 Auclair et al.
2006/0278689 A1 12/2006 Boshinski et al.
2007/0007325 A1 1/2007 Suzuki et al.
2007/0029371 A1 2/2007 Theelen
2007/0108261 A1 5/2007 Schuster
2007/0131748 A1 6/2007 Brand
2007/0164093 A1 7/2007 Spivey et al.
2007/0181658 A1 8/2007 Sutherland
2007/0205255 A1* 9/2007 Dunn ..... 229/117.13
2007/0210144 A1 9/2007 Brand
2007/0251982 A1 11/2007 Brand
2007/0295790 A1 12/2007 Zammit et al.
2008/0023535 A1 1/2008 Holley, Jr.
2008/0048014 A1* 2/2008 Bates ..... 229/117.13
2008/0128479 A1 6/2008 Bates et al.
2009/0282843 A1 11/2009 Brand
2010/0044420 A1 2/2010 Brand et al.
2010/0122999 A1 5/2010 Brand
2010/0237138 A1 9/2010 Bradford

| | | | |
|---|---|---|---|
| 2011/0011924 | A1 | 1/2011 | Spivey et al. |
| 2011/0049228 | A1 | 3/2011 | Brand |
| 2011/0290692 | A1 | 12/2011 | Spivey, Sr. |

FOREIGN PATENT DOCUMENTS

| | | | |
|---|---|---|---|
| EP | 0 066029 | | 12/1982 |
| EP | 1 433 714 | A2 | 6/2004 |
| EP | 1 698 565 | A2 | 9/2006 |
| FR | 2 549 010 | | 1/1985 |
| GB | 2 264 101 | A | 8/1993 |
| JP | 2002-128064 | A | 5/2002 |
| JP | 2006-111342 | A | 4/2006 |
| JP | 2007-055630 | A | 3/2007 |
| JP | 2007-532421 | A | 11/2007 |
| JP | 2010-149927 | A | 7/2010 |
| KR | 10-0154124 | B1 | 2/1999 |
| KR | 10-0371048 | B1 | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | | 6/2005 |
| WO | WO 2005/100175 | A1 | 10/2005 |
| WO | WO 2006/050210 | A2 | 5/2006 |
| WO | WO 2006/050316 | A1 | 5/2006 |
| WO | WO 2007/076544 | A1 | 7/2007 |

OTHER PUBLICATIONS

International Search Report and Written Opinion from PCT/US2010/027597 dated Oct. 27, 2010.

International Search Report and Written Opinion for PCT/US2011/051905 dated Apr. 23, 2012.

International Search Report and Written Opinion from PCT/US2011/055233 dated May 17, 2012.

International Search Report and Written Opinion, mailed May 30, 2011, PCT/US2010/047102.

International Search Report and Written Opinion dated Oct. 25, 2011 for PCT/US2011/037872.

Supplementary European Search Report for EP 10 80 0478 dated Nov. 2, 2012.

Supplementary European Search Report for EP 10 75 4034 dated May 30, 2012.

International Search Report and Written Opinion for PCT/US2012/026050 dated Sep. 21, 2012.

* cited by examiner

CARTON WITH INSERT

CROSS-REFERENCE TO RELATED APPLICATIONS

This application claims the benefit of U.S. Provisional Application No. 61/270,857, which was filed on Jul. 14, 2009, and U.S. Provisional Application No. 61/277,969, which was filed Oct. 1, 2009.

INCORPORATION BY REFERENCE

U.S. Provisional Application No. 61/270,857, which was filed on Jul. 14, 2009, and U.S. Provisional Application No. 61/277,969, which was filed on Oct. 1, 2009, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton comprises a plurality of panels that extends at least partially around an interior of the carton. The plurality of panels comprises a top panel, a bottom panel, a first side panel, and a second side panel. A reinforcing insert comprises a central panel, a first and second reinforcing end flap foldably connected to the central panel, and a first and second reinforcing side flap foldably connected to the central panel. The central panel is in face-to-face contact with the top panel. The first and second reinforcing end flaps are positioned to restrain at least one the plurality of containers that are adjacent each of the respective ends of the carton. The first and second reinforcing side flaps are positioned to restrain at least one of the plurality of containers that is adjacent each of the respective first and second side panels of the carton.

In another aspect, the disclosure is generally directed to a carton for containing a plurality of articles. The carton comprises a plurality of panels that extends at least partially around an interior of the carton. The plurality of panels comprises a top panel, a bottom panel, a first side panel, and a second side panel. A first top end flap is foldably connected to a first end of the top panel and a second top end flap is foldably connected to a second end of the top panel. The first top end flap at least partially closes a first end of the carton, and the second top end flap at least partially closes a second end of the carton. A reinforcing insert comprises a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central panel. An article restraining structure comprises the first reinforcing end flap positioned to contact articles adjacent the first end, the second reinforcing end flap positioned to contact articles adjacent the second end, the first reinforcing side flap positioned to contact articles adjacent the first side panel, and the second reinforcing side flap positioned to contact articles adjacent the second side panel.

In another aspect, the disclosure is generally directed to in combination, a carton blank and an insert blank for forming a carton having article restraining features for retraining movement of articles in the carton. The carton blank comprises a plurality of panels comprising a top panel, a bottom panel, a first side panel, and a second side panel. A first top end flap foldably connected to a first end of the top panel and a second top end flap foldably connected to a second end of the top panel. The first top end flap is for at least partially closing a first end of the carton formed from the carton blank and the insert blank, and the second top end flap if for at least partially closing a second end of the carton formed from the carton blank and the insert blank. The insert blank comprises a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central. The article restraining features comprises the first reinforcing end flap that is for being positioned to contact articles adjacent the first end in the carton formed from the carton blank and the insert blank, the second reinforcing end flap that is for being positioned to contact articles adjacent the second end in the carton formed from the carton blank and the insert blank, the first reinforcing side flap that is for being positioned to contact articles adjacent the first side panel in the carton formed from the carton blank and the insert blank, and the second reinforcing side flap that is for being positioned to contact articles adjacent the second side pane in the carton formed from the carton blank and the insert blank.

In another aspect, the disclosure is generally directed to a method of forming a carton. The method comprising obtaining a carton blank comprising a plurality of panels comprising a top panel, a bottom panel, a first side panel, and a second side panel. A first top end flap foldably is connected to a first end of the top panel and a second top end flap is foldably connected to a second end of the top panel. The first top end flap is for at least partially closing a first end of the carton formed from the blank, and the second top end flap if for at least partially closing a second end of the carton formed from the carton blank and the insert blank. The method comprises obtaining an insert blank comprising a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central. The method comprises positioning the insert blank relative to the carton blank so that the central panel overlaps at least a portion of the top panel. The method comprises forming an article restraining structure comprising the first reinforcing end flap, the second reinforcing end flap, the first reinforcing side flap, and the second reinforcing side flap. The forming the article restraining structure comprises positioning the first reinforcing end flap for contact with articles adjacent the first end in the carton, positioning the second reinforcing end flap for contact with articles adjacent the second end in the carton, positioning the first reinforcing side flap for contact with articles adjacent the first side panel, and positioning the second reinforcing side flap for contact with articles adjacent the second side panel. The method comprises attaching the insert blank to the carton blank, and forming the attached insert blank and carton blank into a carton.

In another aspect, the disclosure is generally directed to the combination of a carton blank and an insert blank.

In another aspect, the disclosure is generally directed to a method of forming a carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
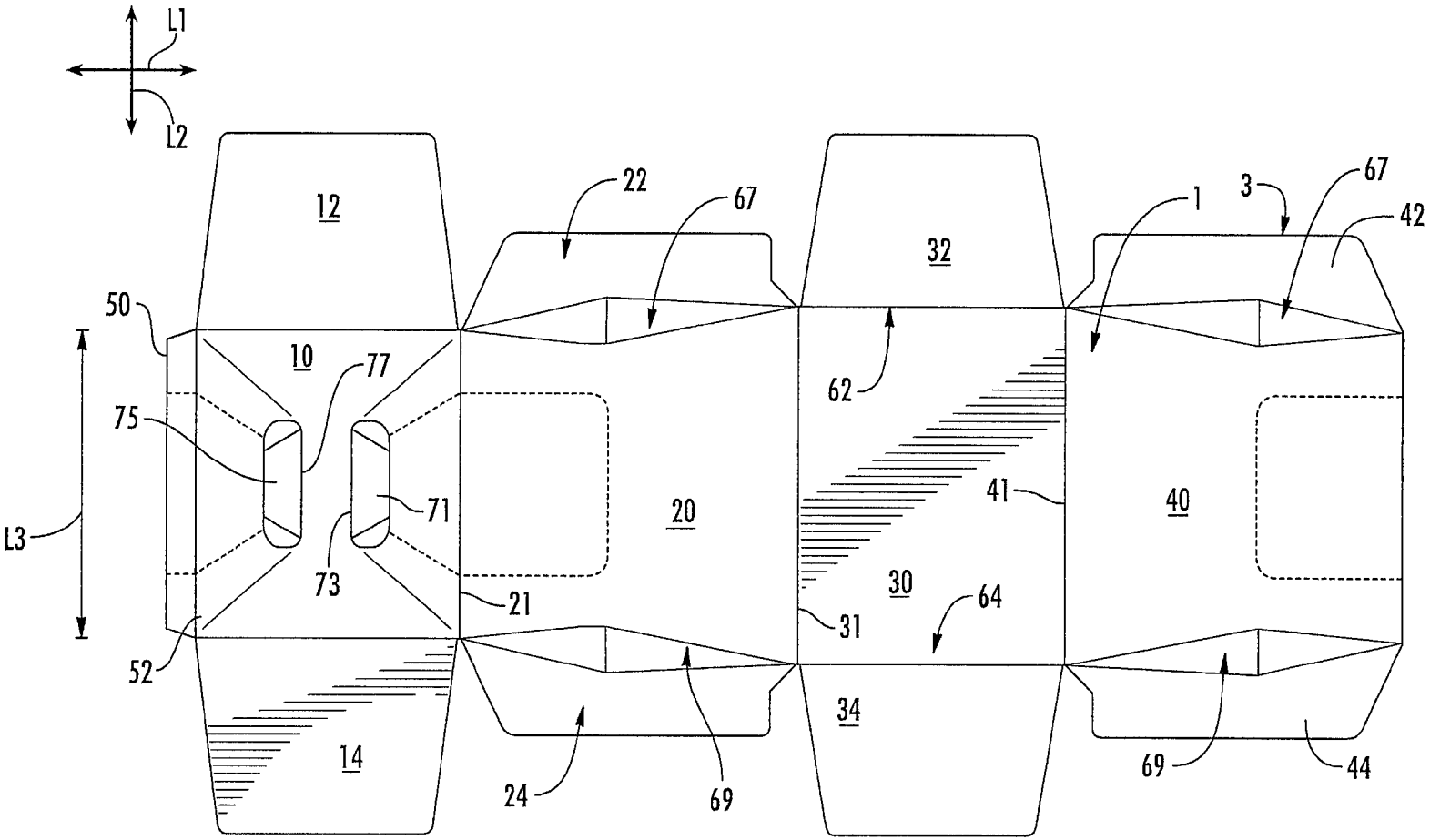
FIG. 1 is a plan view of an exterior surface of a carton blank for forming a carton of a first embodiment of the disclosure.
Figure 11:
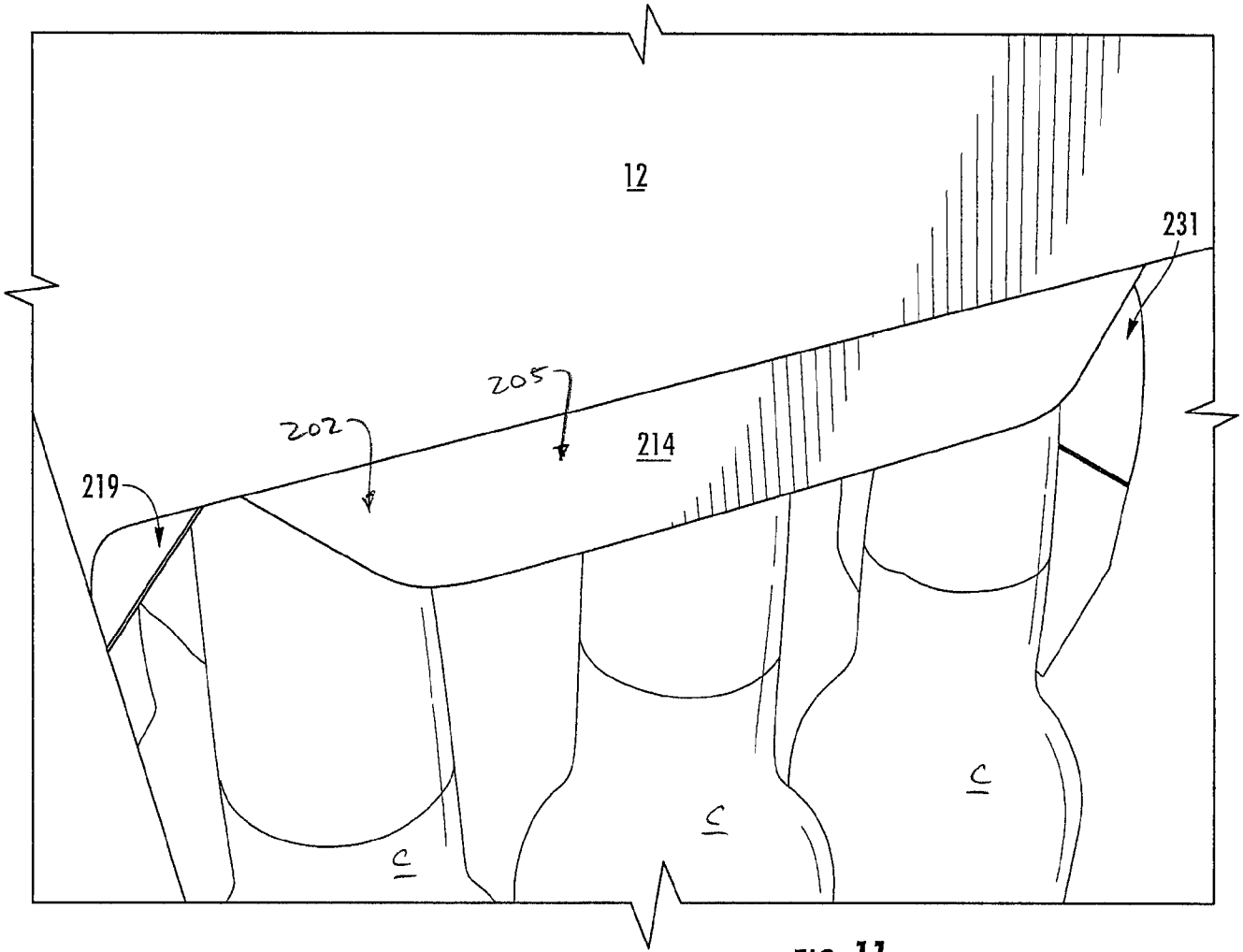

FIG. 1 is a plan view of the exterior side 1 of a blank, generally indicated at 3, used to form a carton 5 (FIG. 3) according to one exemplary embodiment of the disclosure. The carton 5 can be used to house a plurality of articles such as containers C (FIG. 11). In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 3×6, 2×6×2, 4×5, 3×5, 2×9, 2×6, 3×4, etc.). In one embodiment, the carton 5 has a dispenser 7 for accessing the containers C in the carton. In the illustrated embodiment, the carton 5 includes a handle, generally indicated at 11, for grasping and carrying the carton. As will be discussed below in more detail, the carton 5 includes an insert 205 for restraining the movement of the containers C and for reinforcing the carton.

The carton blank 3 has a longitudinal axis L1 and a lateral axis L2. In the illustrated embodiment, the blank 3 comprises a top panel 10 foldably connected to a first side panel 20 at a first lateral fold line 21. A bottom panel 30 is foldably connected to the first side panel 20 at a second lateral fold line 31. A second side panel 40 is foldably connected to the bottom panel 30 at a third lateral fold line 41. In the illustrated embodiment, the blank 3 includes an adhesive flap 50 foldably connected to the top panel 10 at a fourth lateral fold line 52. In alternative embodiments, the blank 3 can be arranged so that the top panel 10 is foldably connected to both the first and second side panels 20, 40, or the blank 3 can have other alternative panel arrangements.

Figure 3:
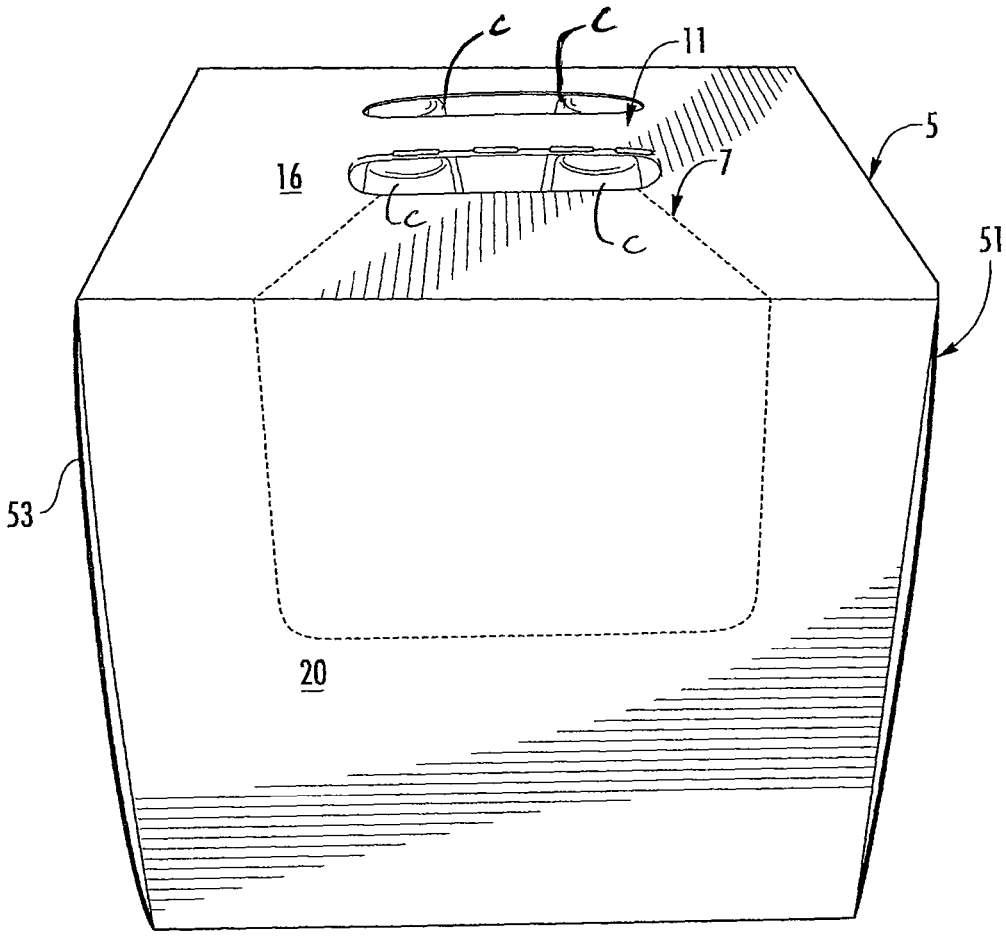
FIG. 3 is a perspective of a carton of the first embodiment.

The top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. When the carton 5 is erected, the top and bottom end flaps 12 and 32 and side end flaps 22 and 42 close a first end 51 of the carton, and the top and bottom end flaps 14 and 34 and side end flaps 24 and 44 close a second end 53 of the carton (FIG. 3). In accordance with an alternative embodiment of the present disclosure, different flap arrangements can be used for at least partially closing the ends 51, 53 of the carton 5.

The top and bottom end flaps 12 and 32 and side end flaps 22 and 42 extend along a first marginal area of the blank 3, and are foldably connected at a first longitudinal fold line 62 that extends along the length of the blank. The top and bottom end flaps 14 and 34 and side end flaps 24 and 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

In the illustrated embodiment, the carton blank 3 includes features to form the carton 5 having tapered ends 51, 53. That is, the blank 3 includes diamond corner panels 67, 69 that connect respective side end flaps 22, 42, 24, 44 to a respective one of the first side panel 20 and the second side panel 40. The diamond corner panels 67, 69 are configured to allow the ends 51, 53 to taper from the bottom to the top with a respective edge of the bottom panel 30 at one end being located farther from the centerline of the carton than a respective edge of the top panel 10 at the second end. The containers C having a wide bottom B and narrow top T can be tightly held in the carton with the narrow tops of the containers located adjacent to the ends 51, 53 being located in close proximity to the portions of the fold lines 62, 64 connecting the top end flaps 12, 14 to the top panel. In alternative embodiments, the carton 5 could be otherwise shaped, arranged, and/or configured. For example, the carton 5 could have substantially straight sides and ends and could be without the diamond corner panels 67, 69 without departing from the disclosure.

As shown in FIG. 1, the features that form the handle 11 of the carton 5 include a first elongate handle flap 71 foldably connected to the top panel 10 at a lateral fold line 73, and a second elongate handle flap 75 foldably connected to the top panel at a lateral fold line 77. The handle 11 may be otherwise shaped and located in the carton 5 without departing from the scope of this disclosure.

Figure 2:
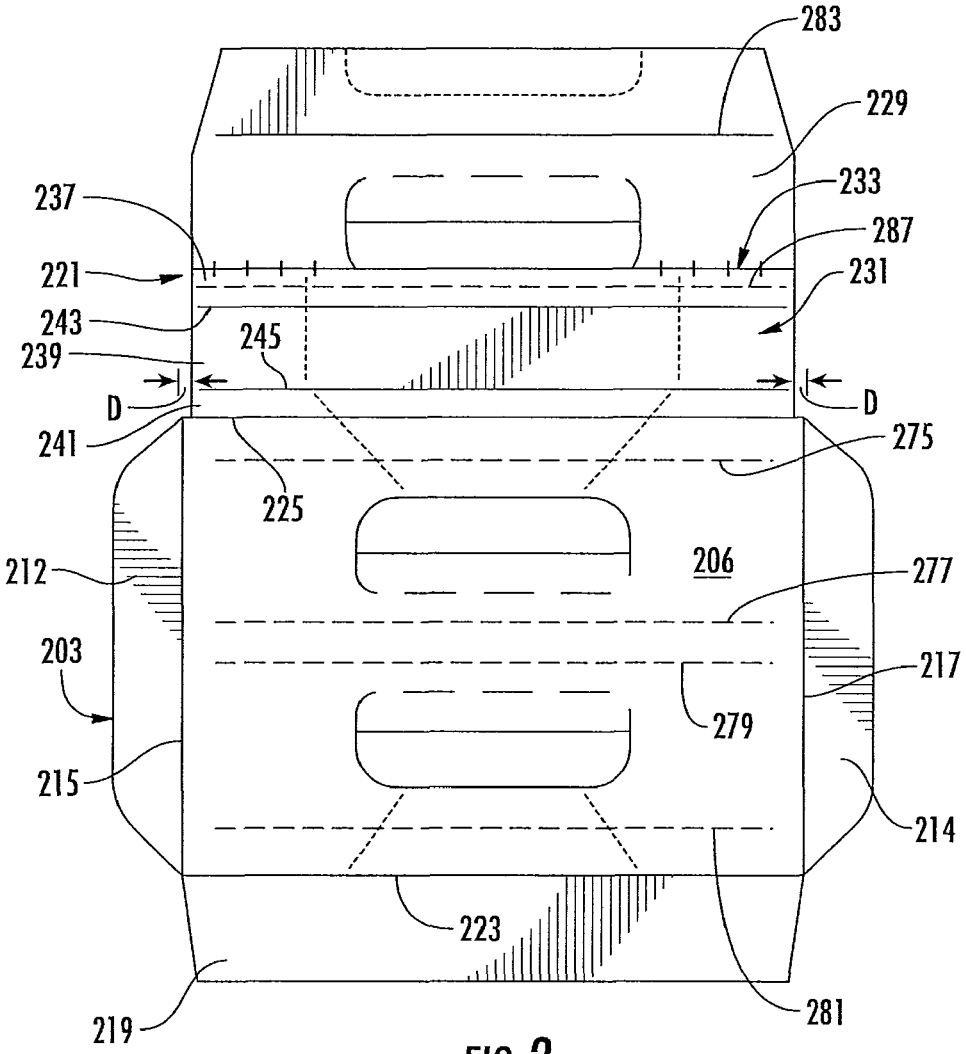
FIG. 2 is a plan view of an exterior surface of an insert blank for forming an insert of a first embodiment of the disclosure.

FIG. 2 illustrates an exterior surface of an insert blank 203 used to form a reinforcing insert 205 (FIG. 10) for use in the carton 5. In the illustrated embodiment, the insert blank 203 includes a central panel 206, two reinforcing end flaps 212, 214 respectively foldably connected to the central panel 206 at respective fold lines 215, 217 at opposite ends of the central panel. The insert blank 203 has two reinforcing side flaps 219, 221 foldably connected to the central panel 206 at respective fold lines 223, 225 at opposite sides of the central panel. In the illustrated embodiment, the reinforcing side flap 221 comprises a handle reinforcing portion 229 that is removably attached to a article restraining portion 231 at a tear line 233. The article restraining portion 231 includes three panels 237, 239, 241 that are independently positionable at respective fold lines 225, 243, 245.

Figure 4:
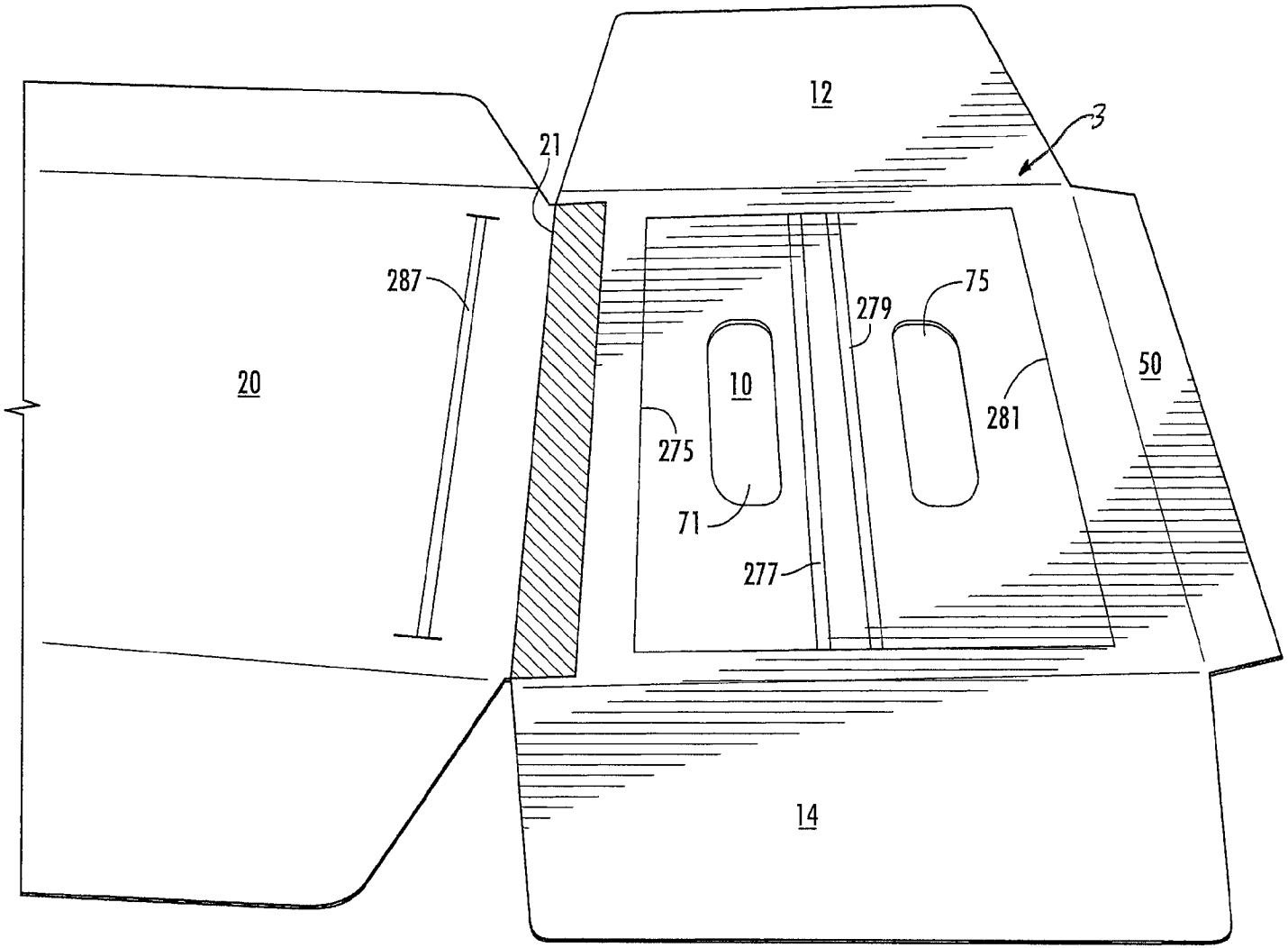
FIG. 4 is an enlarged portion of an interior surface of the carton blank of the first embodiment of the disclosure.
Figure 5:
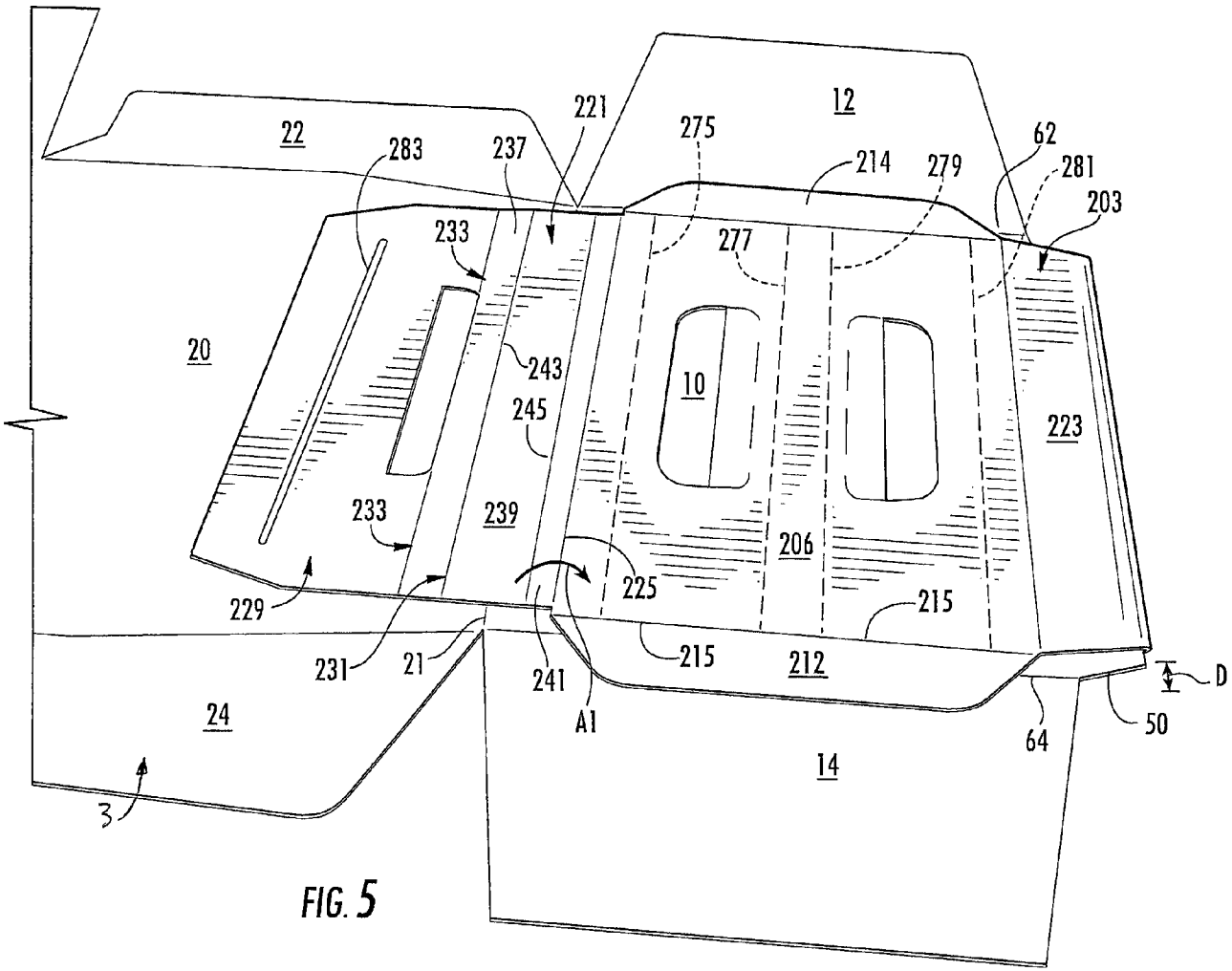
FIG. 5 is a view showing the insert blank positioned on the carton blank and the carton of the first embodiment partially formed.
Figure 6:
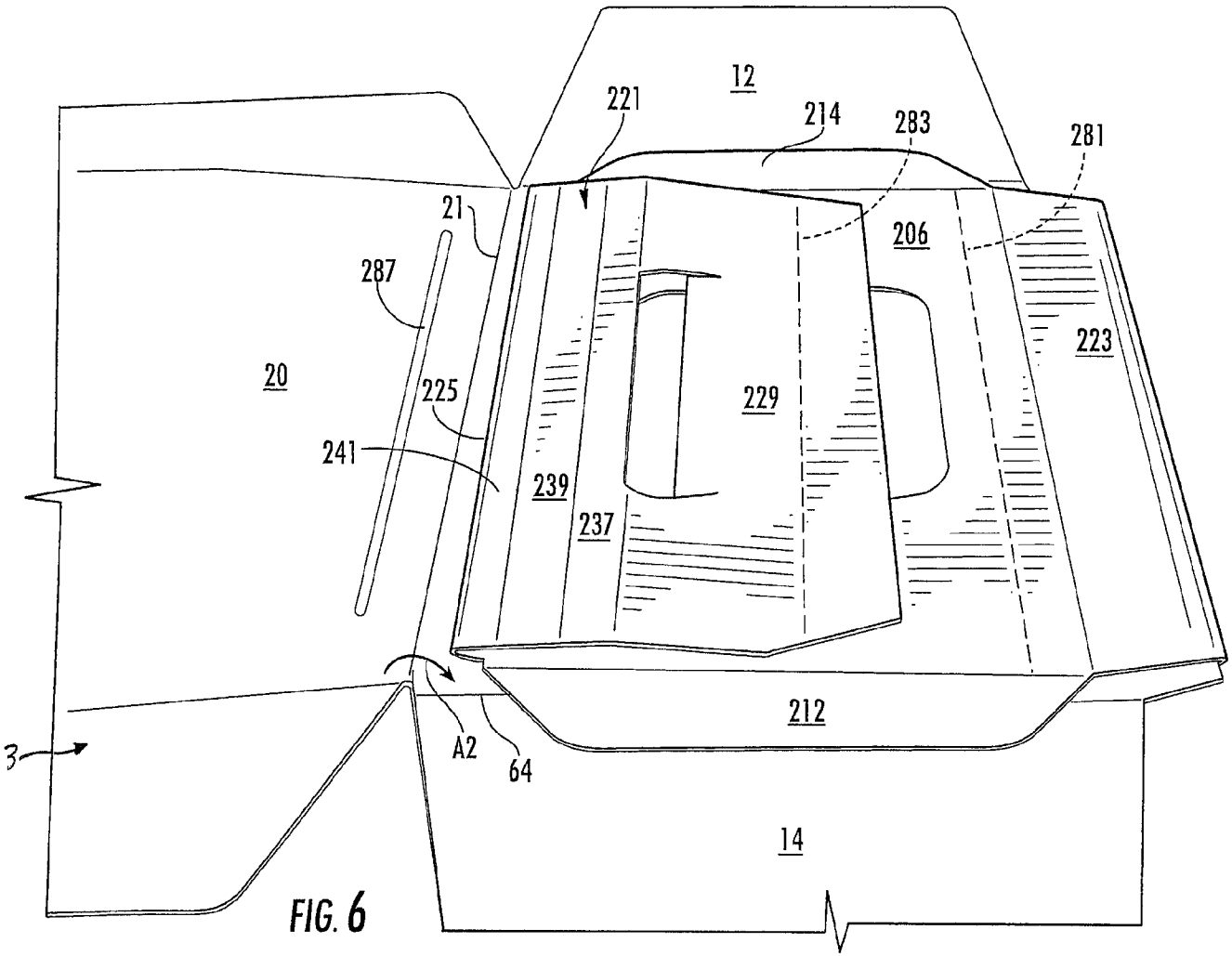
FIGS. 6-9 are various views of the insert blank and the carton blank in various stages of formation of the carton of the first embodiment.
Figure 7:
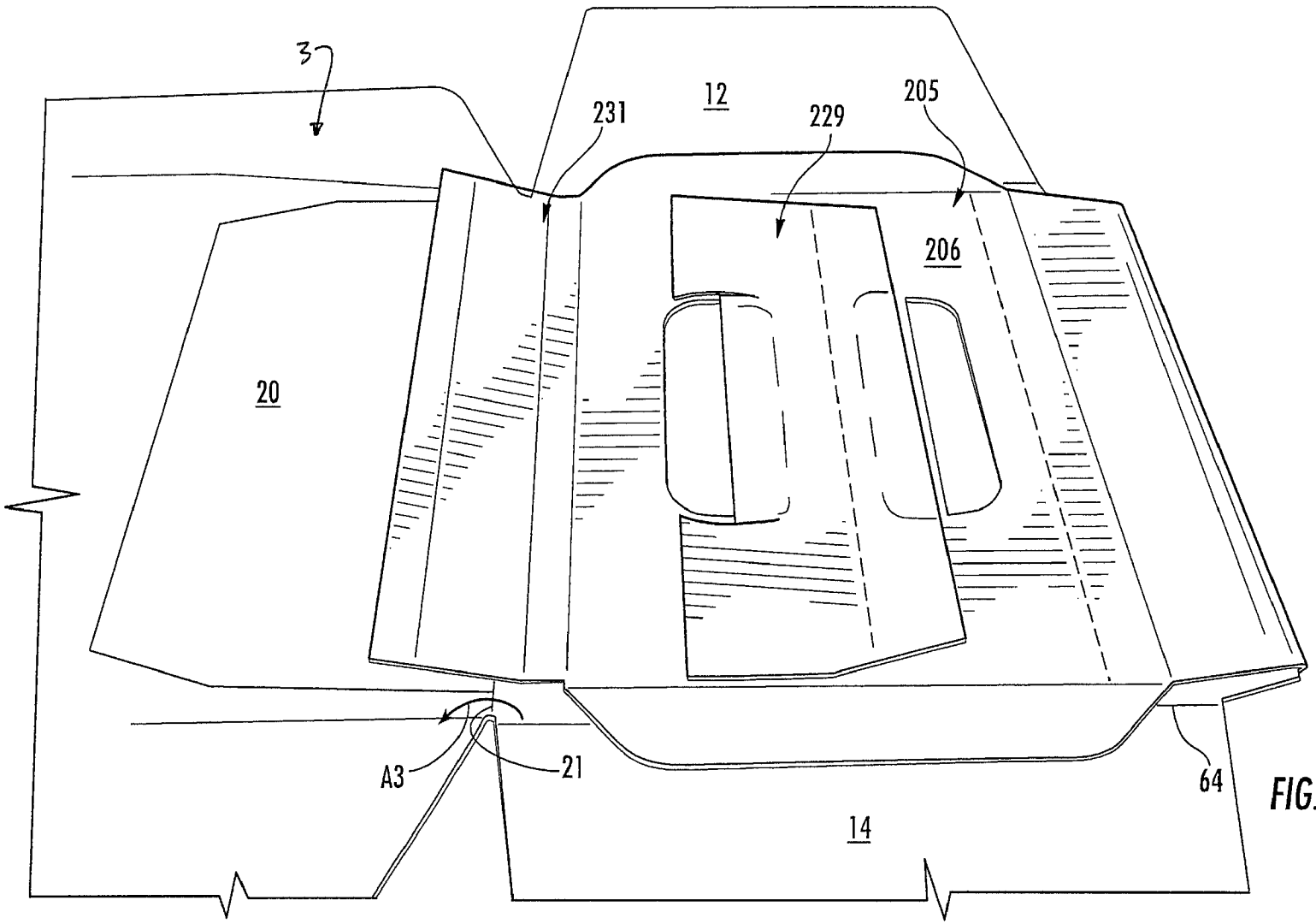
Figure 8:
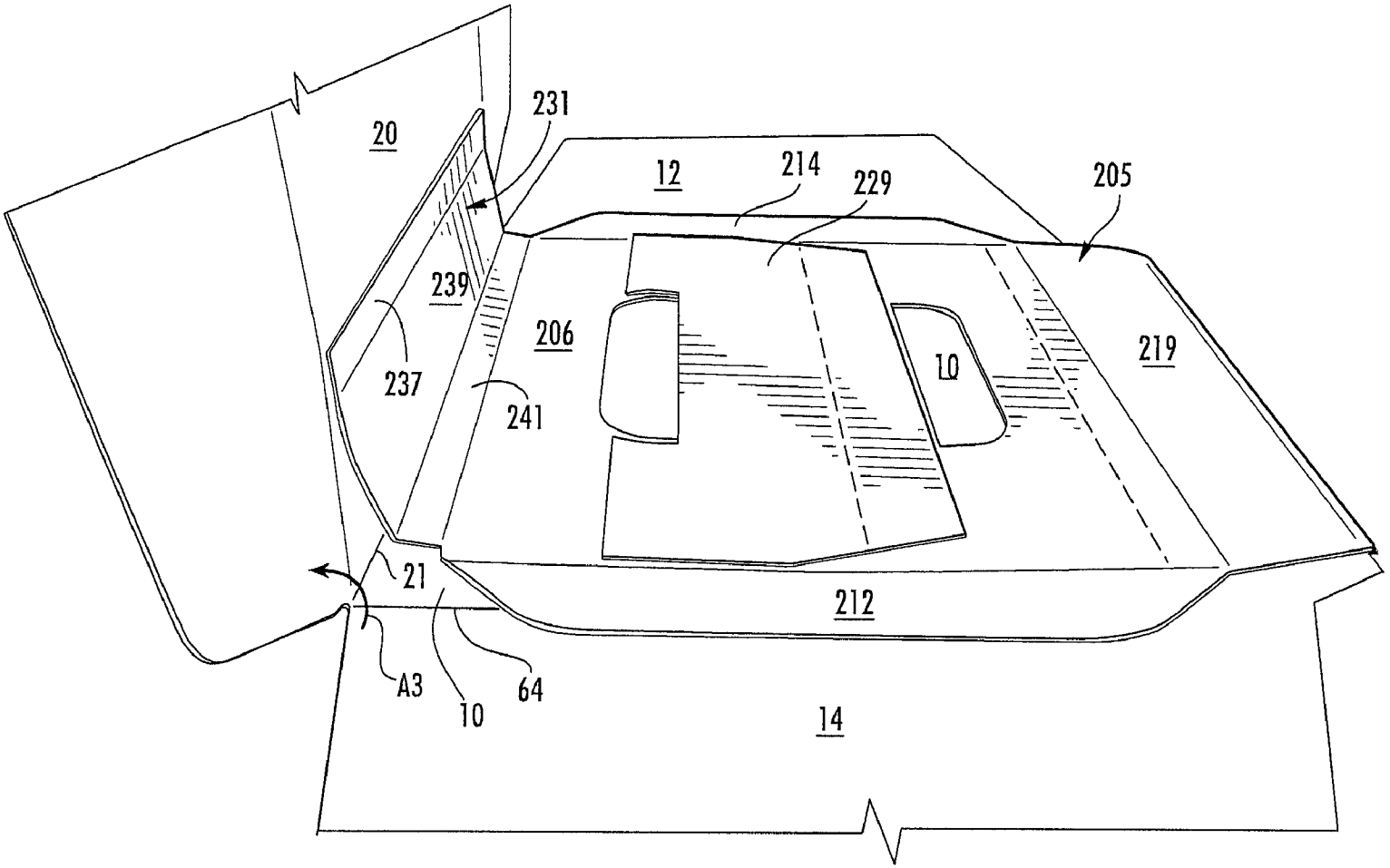
Figure 9:
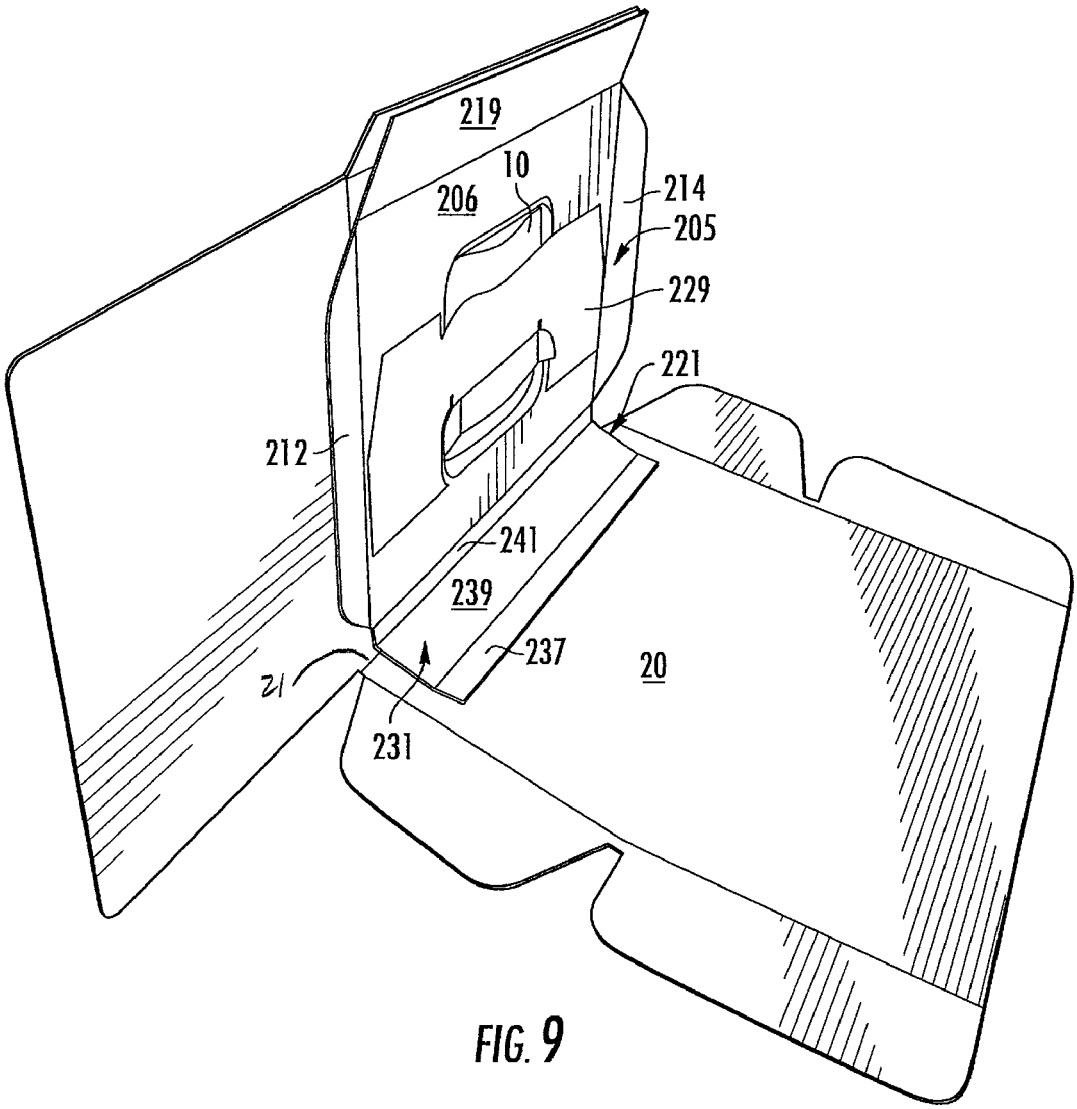

As shown in FIGS. 4-9, in one exemplary embodiment, the carton 5 can be assembled by initially adhering the insert blank 203 to the top panel 10 of the carton blank 3. As shown in FIG. 4, adhesive in the form of glue 275, 277, 279, 281 is applied to the interior surface of the top panel 10 prior to placing the insert blank 203 in face-to-face contact with the top panel. After placing the insert blank 203 on the top panel 10 as shown in FIG. 5, adhesive in the form of glue 283 is applied to the exterior surface of the handle reinforcing portion 229 of the reinforcing side flap 221. Next, the blank 3 of FIG. 5 is folded about fold line 225 (in the direction of arrow A1) so that the reinforcing side flap 221 is folded over the central panel 206 of the insert blank 203 so that the reinforcing side flap is in face-to-face contact with the central panel. The glue 283 on the handle reinforcing portion 229 adheres the reinforcing side flap 221 to the central panel as shown in FIG. 6. Next, adhesive in the form of glue 287 is applied to the side panel 20 as indicated in FIG. 6. Next, the blank 3 is folded about working score line 21 (in the direction of arrow A2) so that the side panel 20 overlaps the insert blank 203. A portion of the side panel 20 is brought into face-to-face contact with the reinforcing side flap 221. When the side panel 20 is folded about score line 21, the glue 287 is brought into contact with the panel 237 of the container reinforcing portion 231 so that the panel 237 is adhered to the side panel 20. When the side panel 20 is folded in the direction of arrow A3 (FIGS. 7 and 8), the container reinforcing portion 231 that is adhered to the side panel separates from the handle reinforcing portion 229 that is adhered to the central panel 206 along tear line 233.

The handle reinforcing portion 229 of the insert 205 remains secured to the central panel 206 below the handle 11 in the top panel 10 to provide three layers of material in the area of the handle (the top panel 10, the central panel 206, and the handle reinforcing portion 229). The container reinforcing portion 231 remains foldably connected to the central panel 206 and is adhesively secured to the side panel 20. As shown in FIG. 11, the portions 239, 241 of the container reinforcing portion 231 are free from attachment to the top panel 10 or the side panel 20 and are spaced in from the corner of the carton 5 at the fold line 21 to restrain the containers C that are adjacent to the side panel 20.

In one embodiment, the reinforcing side flap 219 is foldable connected to the central panel 206 and is free from attachment to the side panel 40 and adhesive flap 50. The reinforcing side flap 219 extends downward from the central panel and is spaced in from the corner of the carton 5 at the fold line 52 to restrain the containers C that are adjacent to the side panel 40.

In the illustrated embodiment, the reinforcing end flaps 212, 214 are downwardly folded at a respective fold line 215, 217 in the insert 205 when a respective top end flap 12, 14 is downwardly folded to close an end 51, 53 of the carton 5. In one embodiment, the fold lines 215, 217 are each spaced apart from a respective portion of the longitudinal fold lines 62, 64 that connect a respective top end flap 12, 14 to the top panel and are closer to the interior of the carton 5 than the longitudinal fold lines by a distance D (FIG. 5). In one embodiment, the distance D can be at least about 3 mm (0.118"), or the distance D could be less than 3 mm without departing from the scope of this disclosure. The spacing of the fold lines 215, 217 inward closer to the interior of the carton 5 from the fold lines 62, 64 allows the reinforcing end flaps 212, 214 to provide a tighter restraint on movement of the containers C that are adjacent a respective end 51, 53 of the container.

Figure 10:
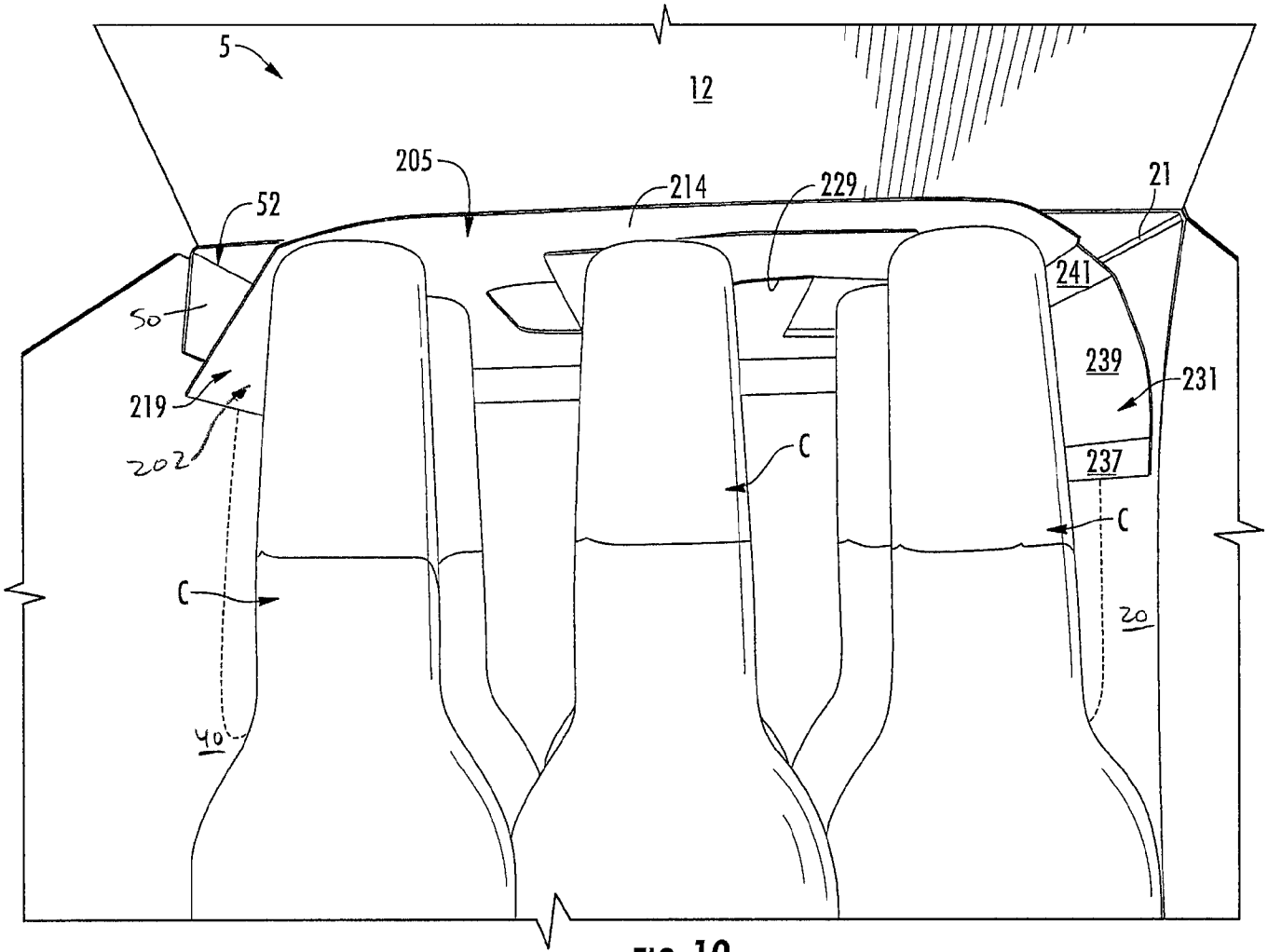
FIGS. 10-12 are various views of the articles received in the carton and an article restraining structure of the first embodiment.
Figure 12:
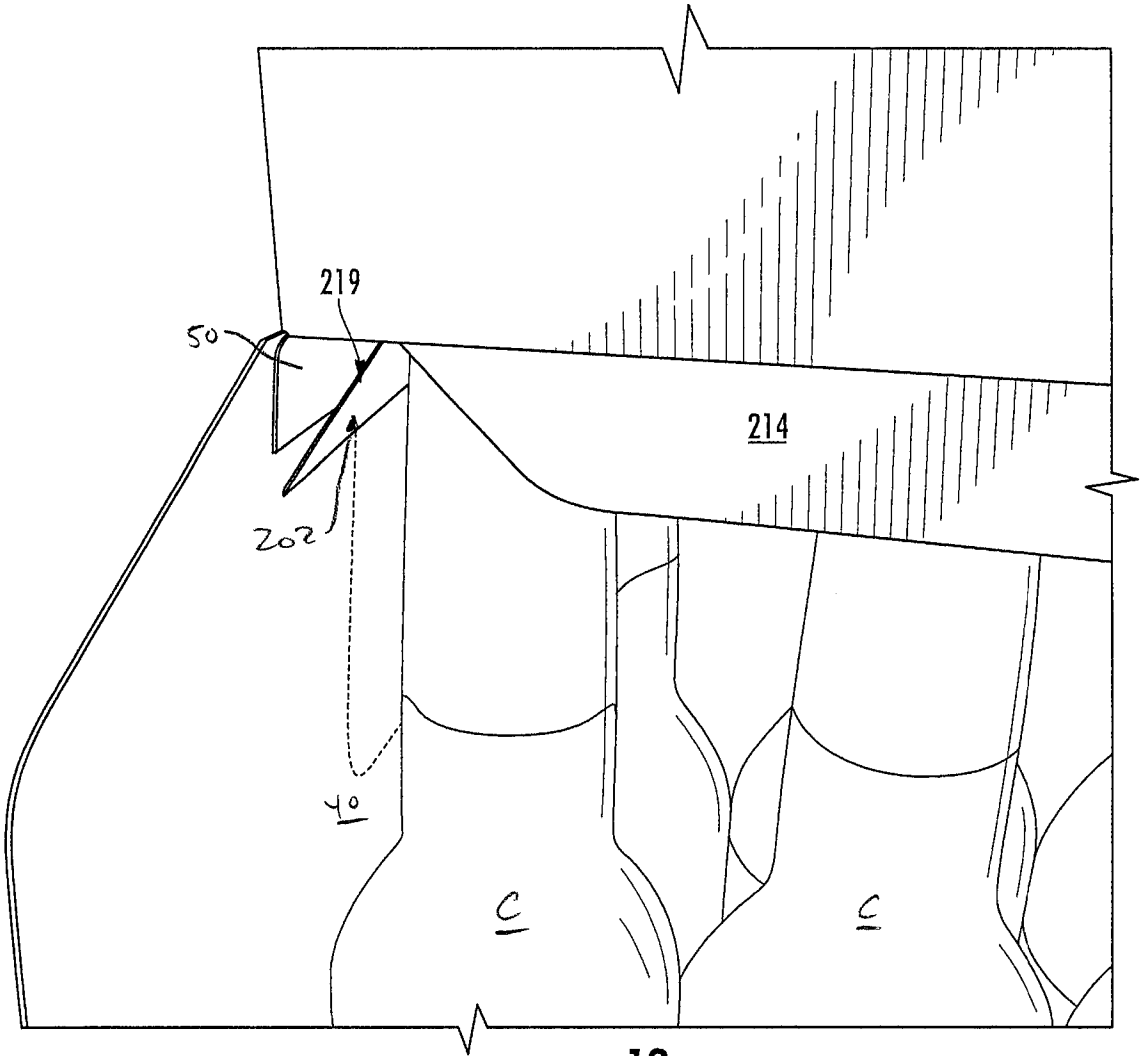

As shown in FIGS. 10-12, the reinforcing end flaps 212, 214, the reinforcing side flap 219, and the container reinforcing portion 231 of the reinforcing side flap 221 form an article restraining structure 202 of the insert 205 that provides restraint to the tops of the containers C on the four sides of the carton 5. In this manner, the containers C are prevented from excessive movement in the carton.

Figure 13:
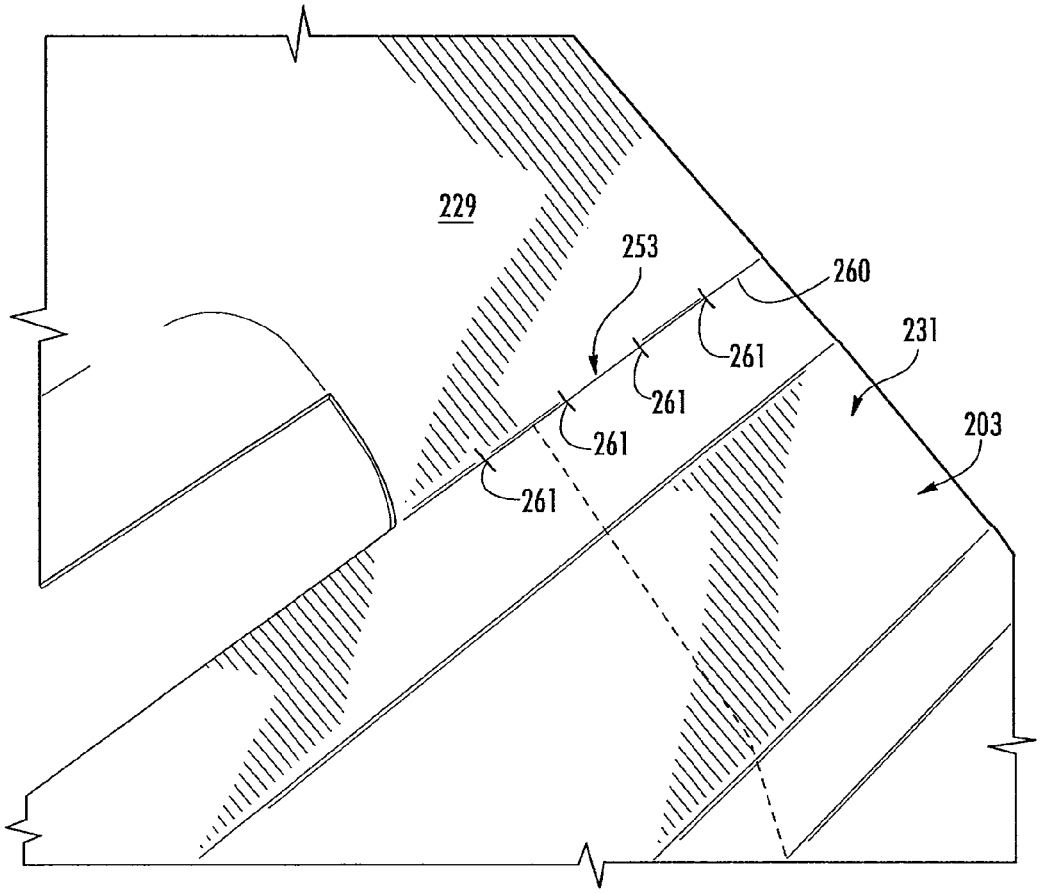
FIG. 13 is an enlarged view of an insert blank of the first embodiment.
Figure 14:
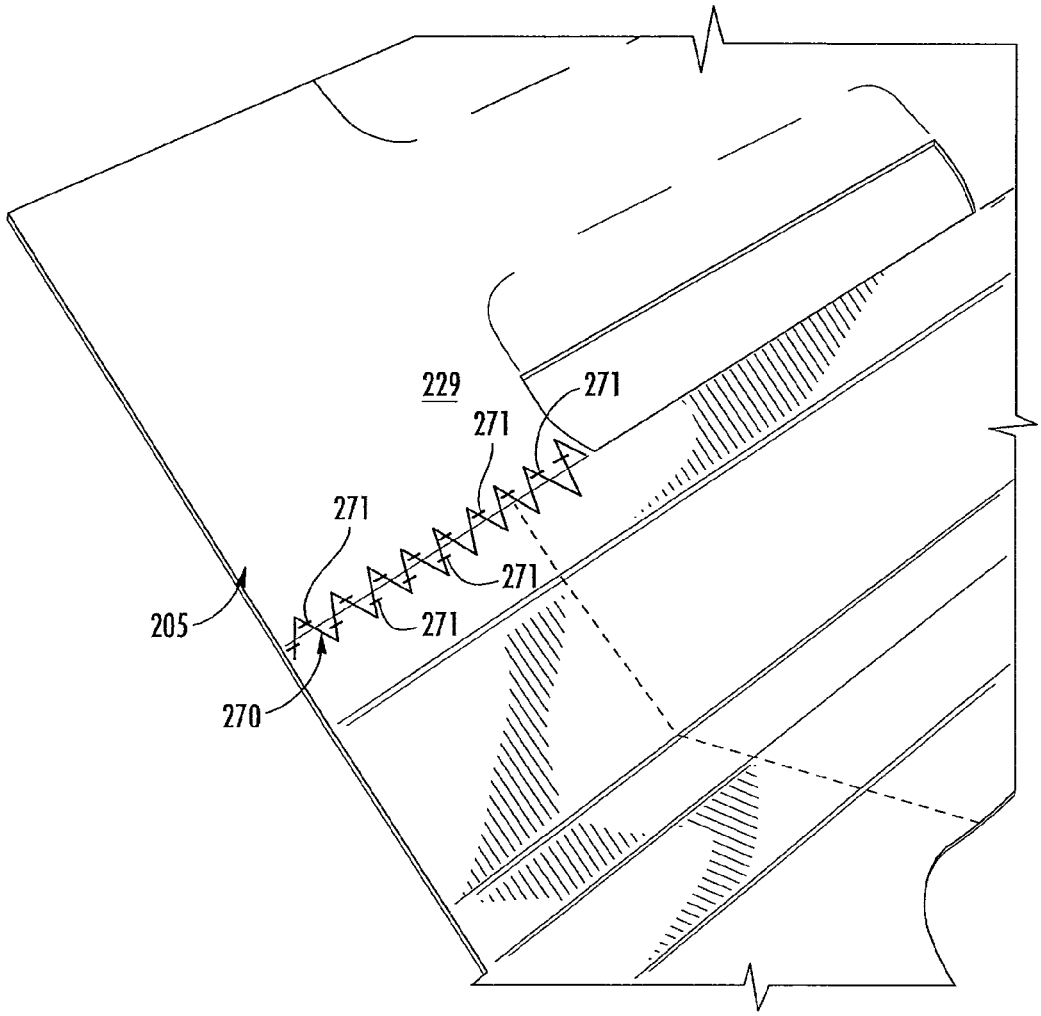
FIG. 14 is an enlarged portion of an alternative embodiment of the insert blank.

FIG. 13 is an enlarged view of the insert blank 203 showing a portion of the tear line 233. The tear line 233 includes a straight cut line 260 with a series of spaced apart nicks 261 that are portions of material that are torn to separate the handle reinforcement portion 229 from the container reinforcement portion 231. Alternatively as shown in FIG. 14, the tear line 233 could be formed by a cut line 270 having V-shaped portions and two nicks 271 on each V-shaped portion of the cut. Alternatively, the tear line 233 could be other configurations.

Figure 15:
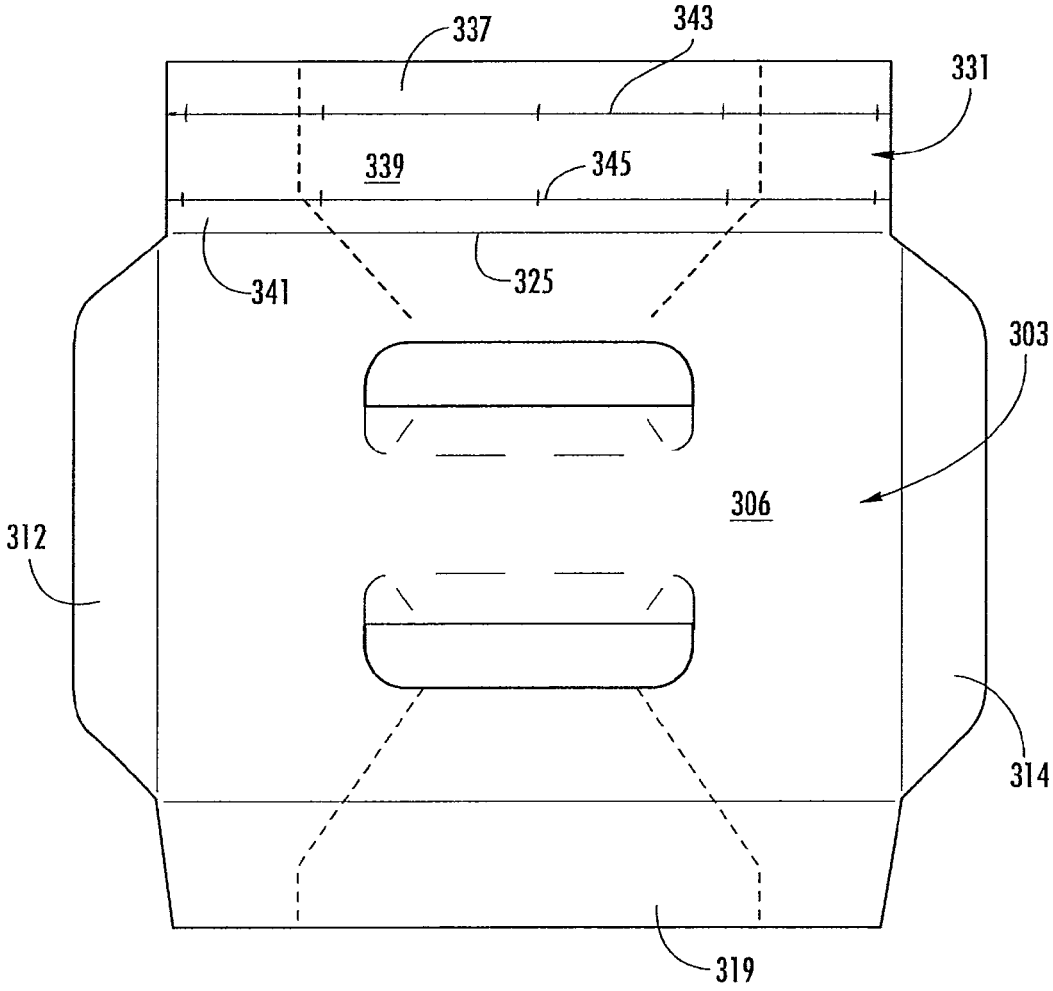
FIG. 15 is a plan view of an exterior surface of an insert blank for forming an insert of a second embodiment of the disclosure.
Figure 16:
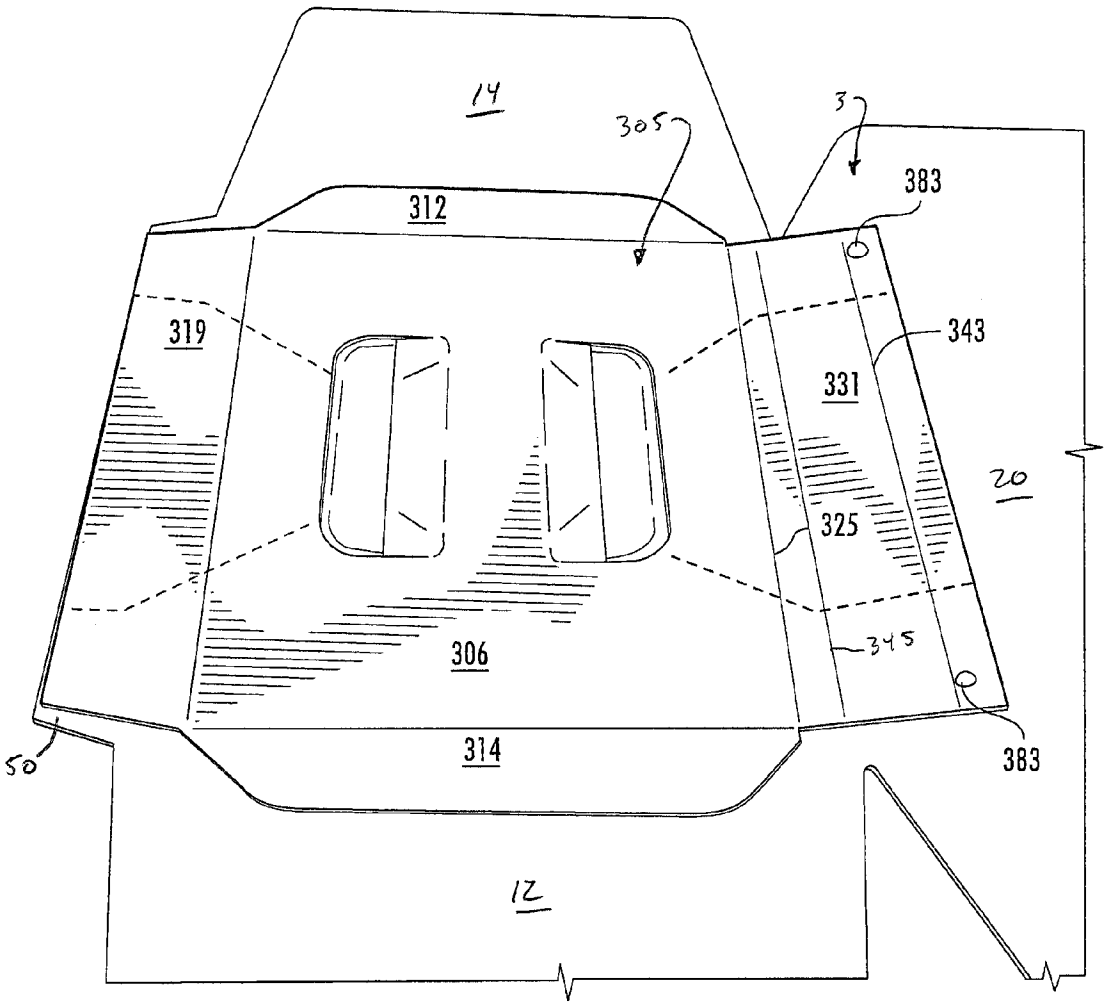
FIGS. 16-19 are various views of the insert blank and the carton blank in various stages of formation of the carton of the second embodiment.

FIG. 15 illustrates an alternative embodiment of an insert blank 303 for use in forming an insert 305 placed in the carton 5. Accordingly, like or similar features may be indicated by like or similar reference numbers from the first embodiment. The blank 303 has a central panel 306, reinforcing end flaps 314, 312, and reinforcing side flaps 319, 331. The insert 305 differs from the first embodiment in that the second embodiment does not include a handle reinforcing portion 229. The reinforcing side flap 331 functions in a similar manner as the reinforcing portion 231 of the reinforcing side flap 221 of the first embodiment. The reinforcing side flap 331 has respective portions or panels 337, 339, 341 respectively foldably connected at fold lines 325, 343, 345. In the article retaining structure 302 formed from the insert 305, panel 337 can be adhesively secured to the side panel 20 and the other two panels 339 and 341 can being free from attachment to the side panel 20 or the top panel 10.

Figure 17:
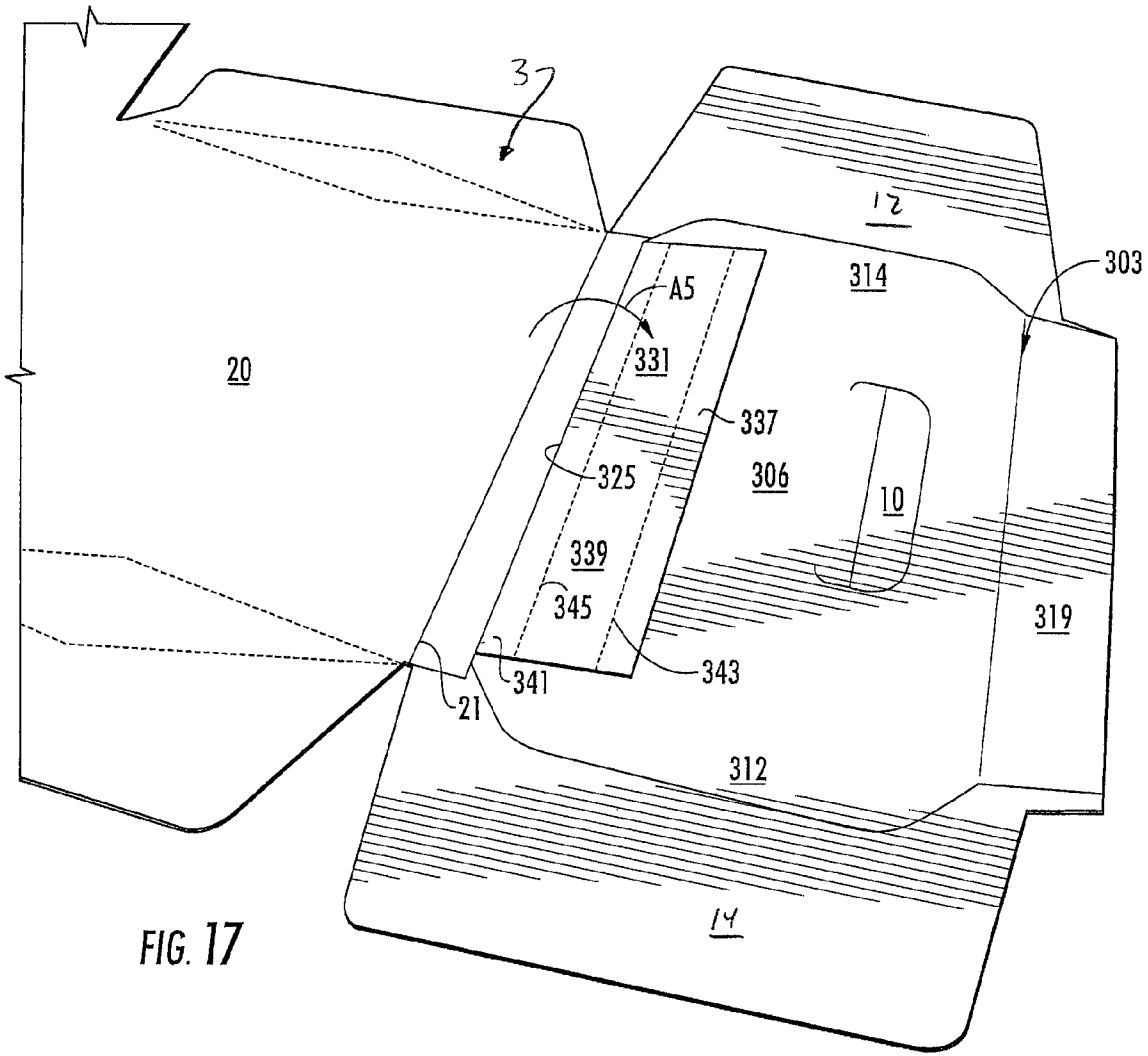
Figure 18:
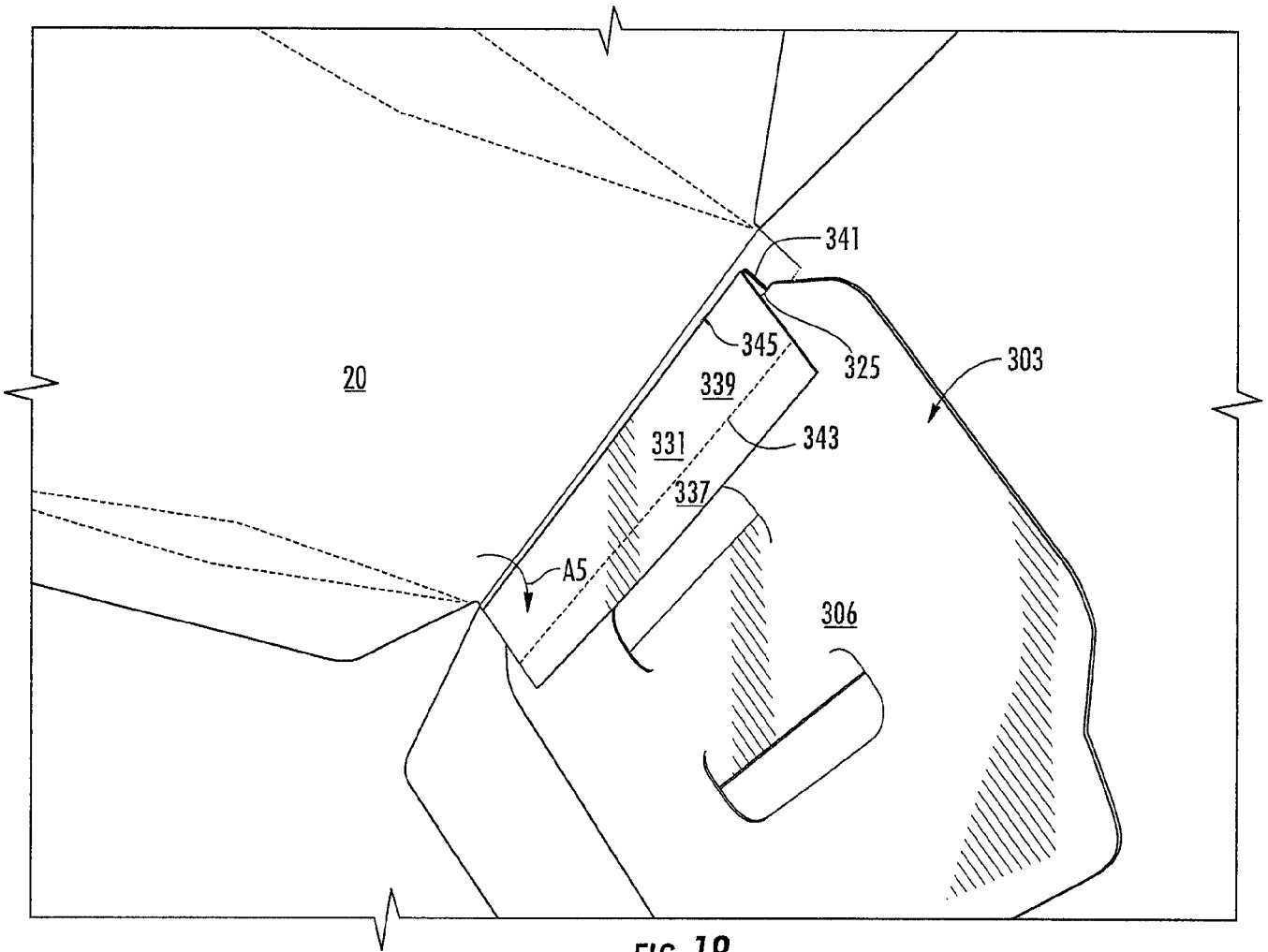

FIGS. 16-19 illustrate the second embodiment of the insert blank 303 being formed into an insert 305 that is attached to the carton 5 and has article retaining structure 302. The insert 305 is formed in a similar manner as illustrated above for the insert 205 of the first embodiment. First, the central panel 306 is attached to the top panel 10. Next, the reinforcing side flap 331 is folded about fold line 325 and temporarily attached to the central panel 306 by glue 383 (FIG. 17). Alternatively as shown in FIG. 18, the reinforcing side flap 331 could be folded at fold line 345 without departing from the scope of the disclosure. Next, glue can be applied to the side panel 20 in a similar manner as the first embodiment. When the carton 5 is erected by folding about fold line 21 in the direction of arrow A5, the side panel 20 is brought into fact-to-face contact with the side reinforcing flap 331, so that the glue contacts the panel 337 of the reinforcing side flap 331. When the carton 5 is further formed by folding in the direction of arrow A6 (FIG. 19), the reinforcing side flap 331 folds relative to the central panel 306 at the fold line 325.

Figure 19:
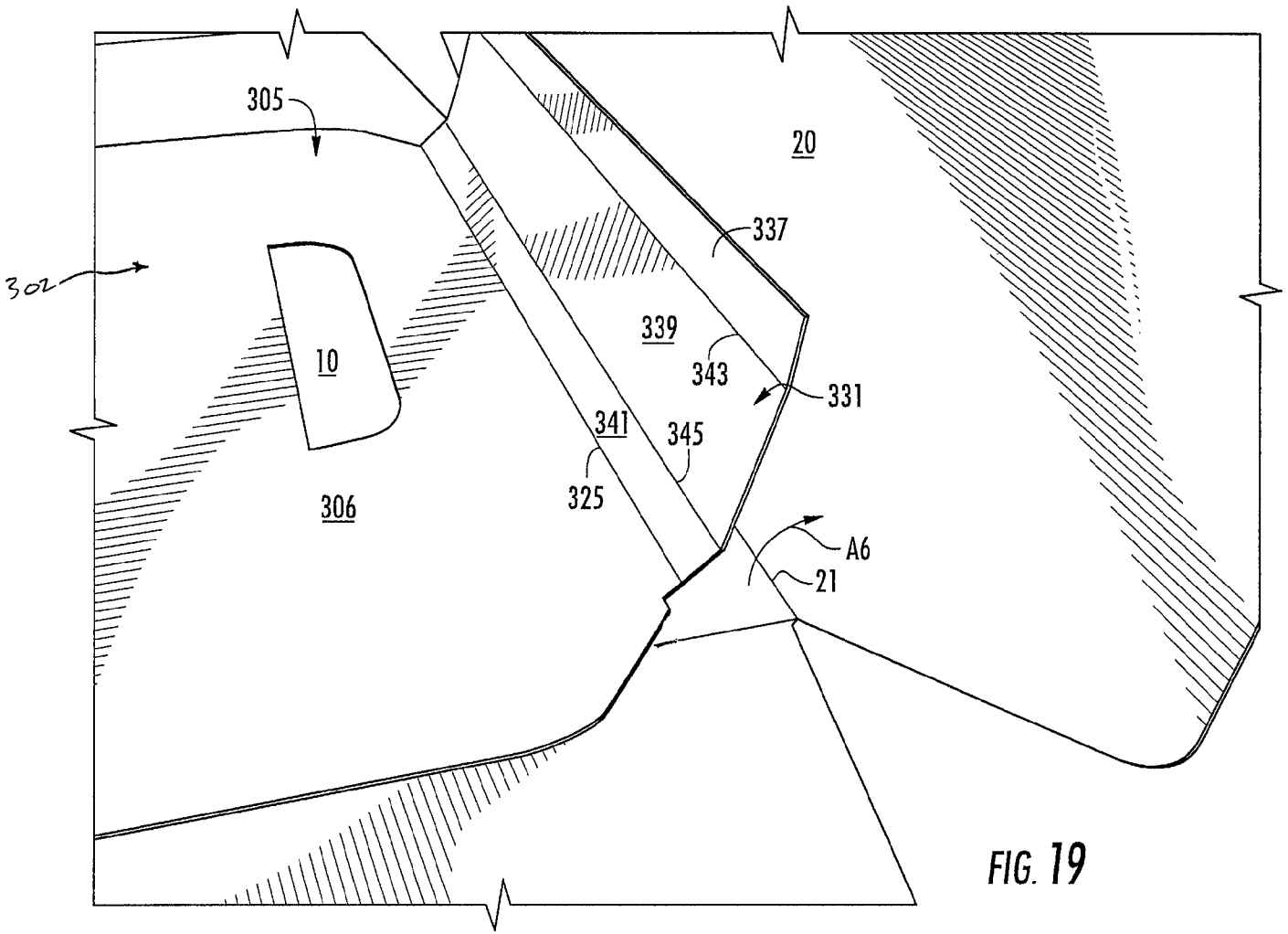

As shown in FIG. 19 the portions 339, 341 of the reinforcing side flap 331 are free from attachment to the top panel 10 or the side panel 20 and the portion 337 is adhesively attached to the side panel 20. The reinforcing end flaps 312, 314 are located in a similar manner as the first embodiment to restrain the containers C that are adjacent the ends 51, 53 of the carton. As with the first embodiment, the article restraining structure 302 comprises the reinforcing end flaps 312, 314 and the reinforcing side flaps 319, 331 that are positioned to be folded downward from the central panel 306 and have a portion free from attachment to the carton 5 so that the reinforcing end flaps and reinforcing side flaps contact the tops of containers C loaded in the carton at the sides and ends of the carton.

Figure 20:
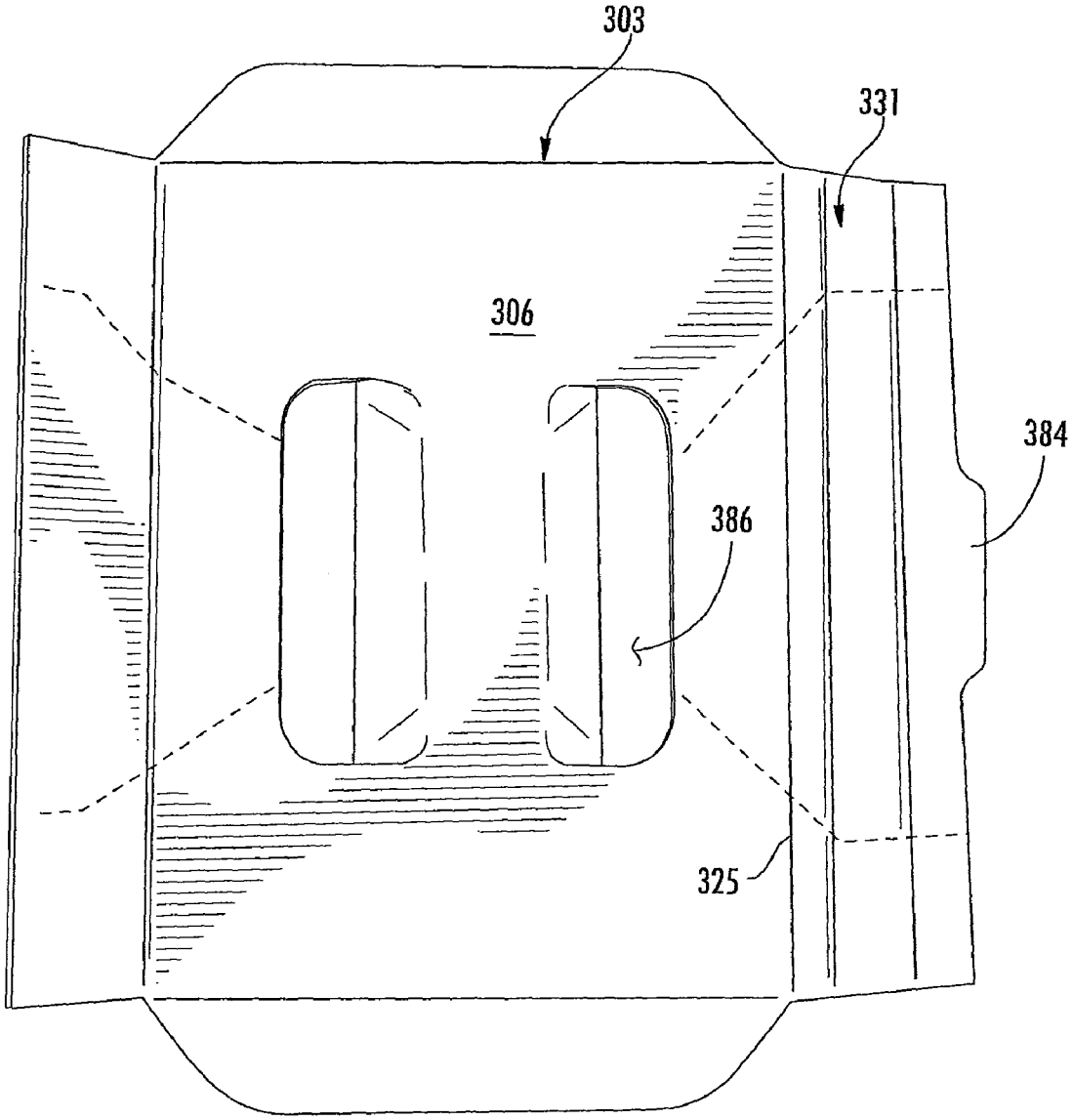
FIG. 20 is an alternative embodiment of the insert blank.
Figure 21:
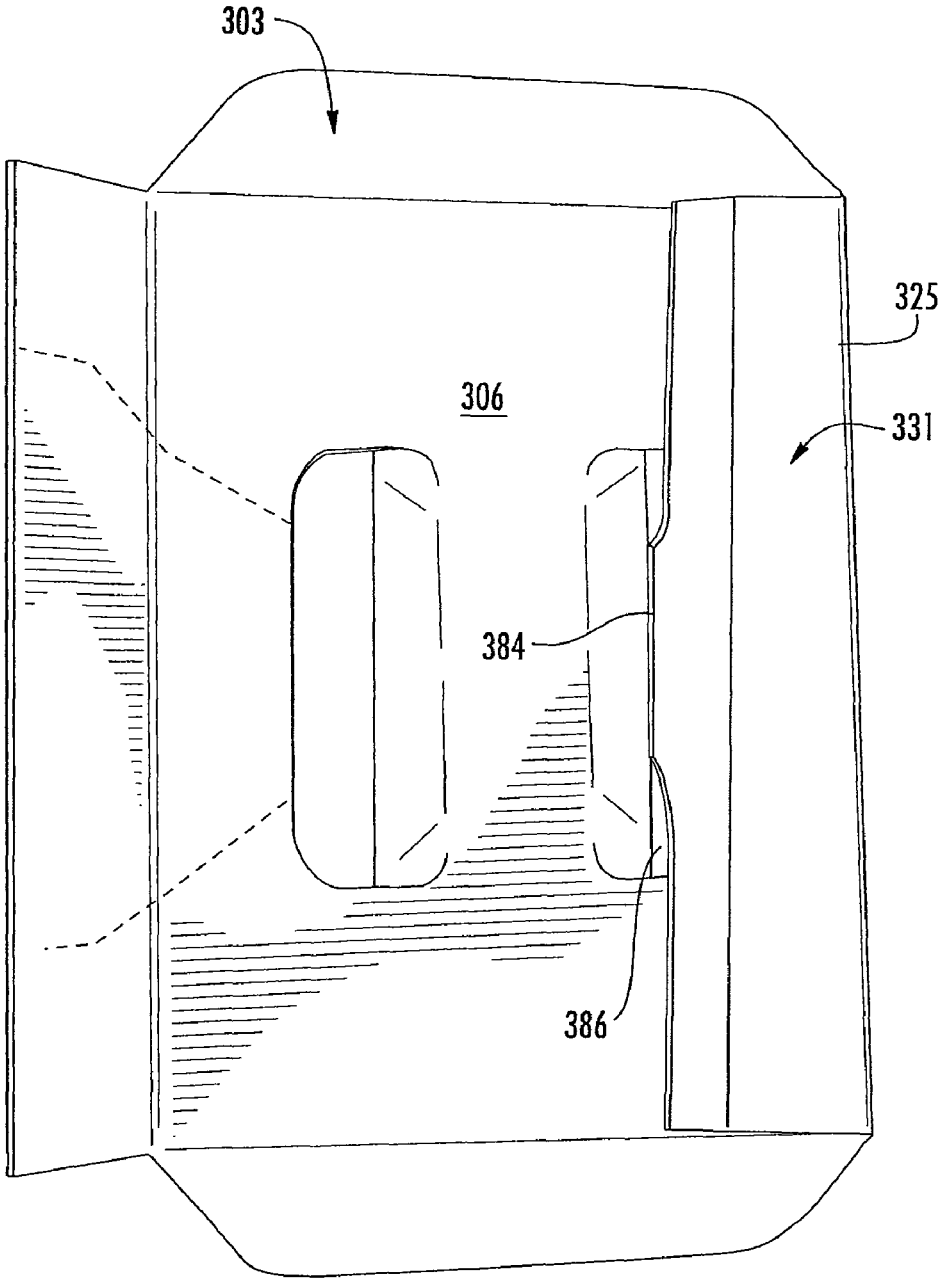
FIG. 21 is a plan view of the insert blank of FIG. 20 in a partially assembled state.

FIGS. 20 and 21 illustrate an alternative embodiment of the insert blank 303 that includes a tab 384 on a free edge of the reinforcing side flap 331. The tab 384 is positioned to fit within one of the handle opening 386 of the central panel 306 when the reinforcing side flap 331 is folded over the central panel. The retention features of the tab 384 in the opening 386 eliminates the need for glue 383 to temporarily hold the reinforcing side flap 331 in contact with the central panel 306 when the glue 287 is applied to the side panel 20. The insert blank 303 may have alternative retention features without departing from the disclosure. Further, the insert blank 303 can be otherwise shaped, arranged and/or configured without departing from the disclosure.

Figure 22:
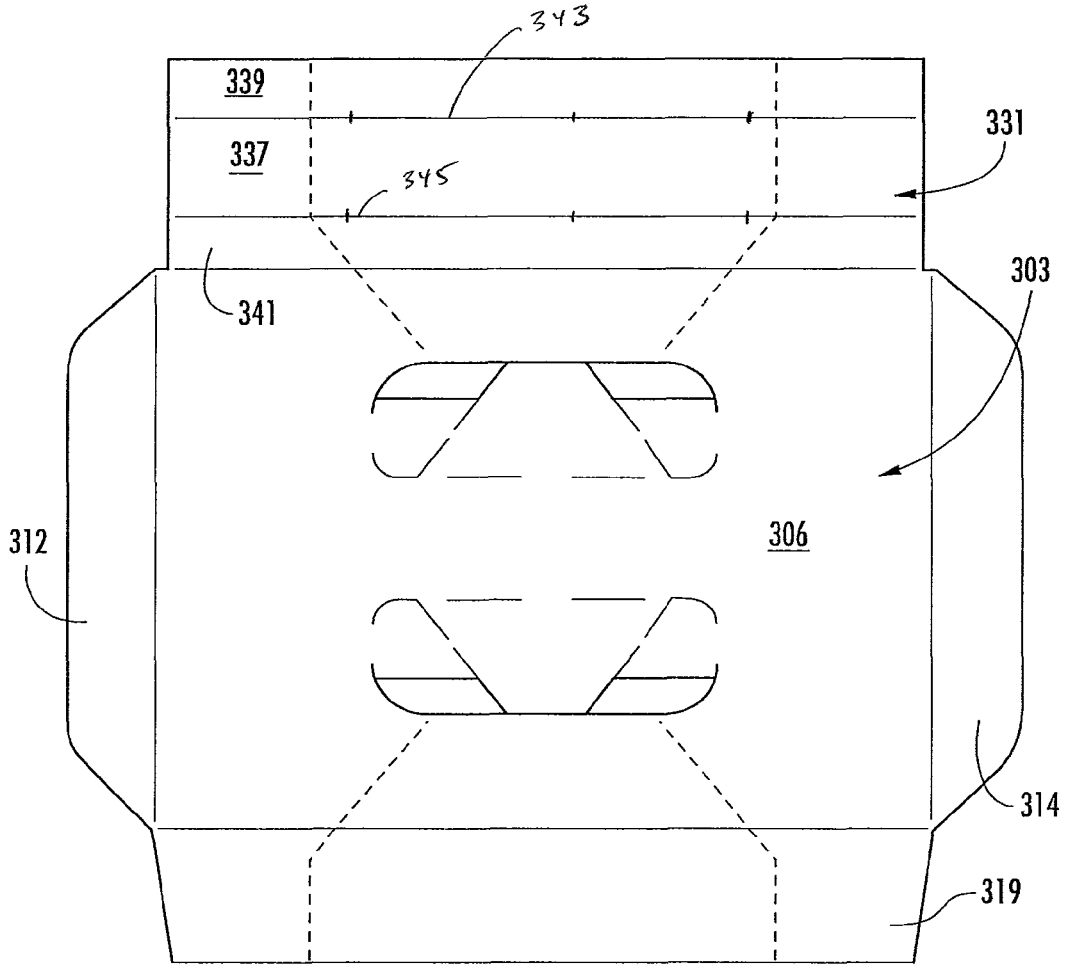
FIG. 22 is an alternative embodiment of the insert blank.

FIG. 22 illustrates an alternative embodiment of an insert blank 303 for use in forming an insert 305 placed in the carton 5. Accordingly, like or similar features may be indicated by like or similar reference numbers from the previous embodiments. The embodiment of FIG. 22 differs from the embodiment of FIG. 15 in that the handle features in the central panel 306 of FIG. 22 vary from the handle features shown in the embodiment of FIG. 15. Also, in the embodiment of FIG. 25, the fold lines 343, 345 in the reinforcing flap 331 that connect the portions 339, 341 to the central portion 337 of the flap have a fewer amount of nicks spaced across the length of the fold lines as compared to the embodiment of FIG. 17. The insert blank 303 of FIG. 22 may be otherwise shaped, arranged, and configured without departing from this disclosure.

Figure 23:
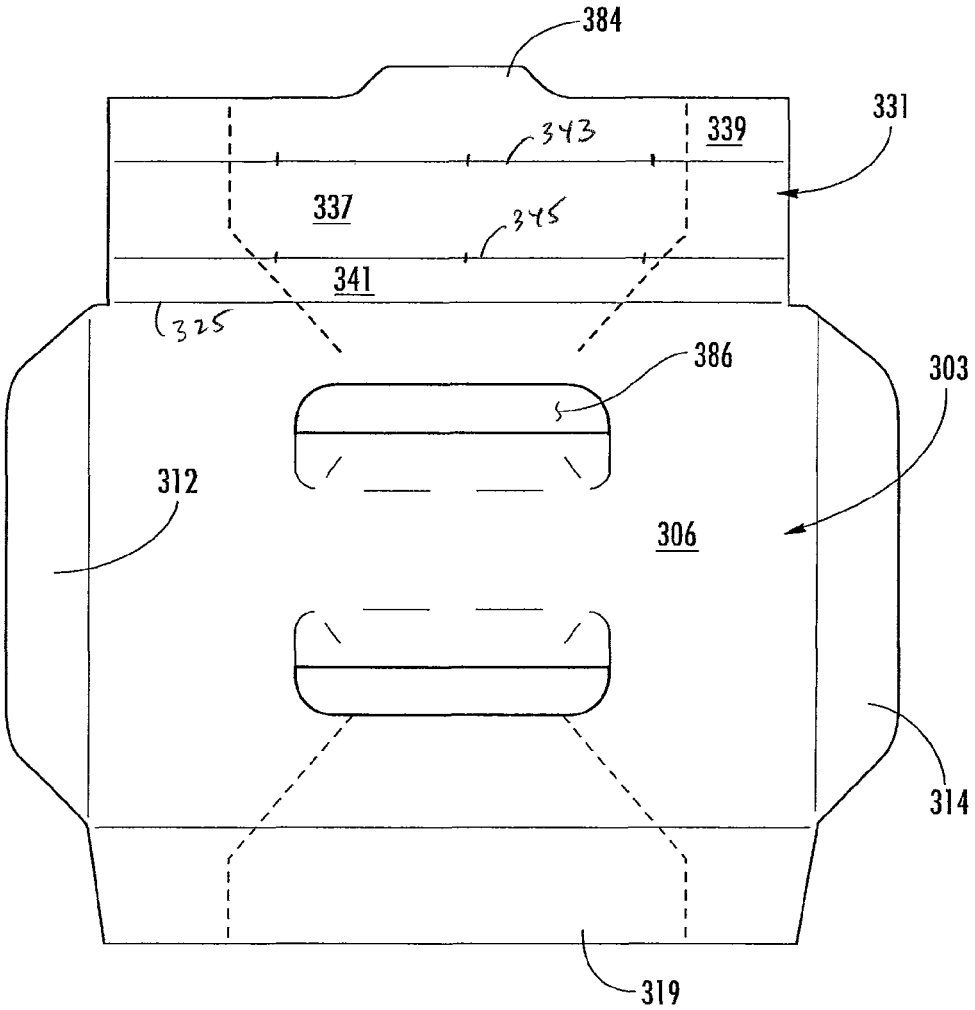
FIG. 23 is an alternative embodiment of the insert blank.

FIG. 23 illustrates an alternative embodiment of an insert blank 303 for us in forming an insert 305 placed in the carton 5. Accordingly, like or similar features may be indicated by like or similar reference numbers from the previous embodiments. The embodiment of FIG. 23 is similar to the embodiment of FIG. 20 in that the reinforcing side flap 331 includes a tab 384 for being received in the handle opening 386 when the reinforcing side flap 331 is folded over the central panel. In the embodiment of FIG. 23, the length of the reinforcing side flap 331 is less than the length of the central panel 306 of the insert blank 303. The insert blank 303 of FIG. 26 may be otherwise shaped, arranged, and configured without departing from this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprises a top panel, a bottom panel, a first side panel, and a second side panel;

a first top end flap foldably connected to a first end of the top panel and a second top end flap foldably connected to a second end of the top panel, wherein the first top end flap at least partially closes a first end of the carton, and the second top end flap at least partially closes a second end of the carton;

a reinforcing insert comprising a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central panel; and an article restraining structure comprising the first reinforcing end flap positioned to contact articles adjacent the first end, the second reinforcing end flap positioned to contact articles adjacent the second end, the first reinforcing side flap positioned to contact articles adjacent the first side panel, and the second reinforcing side flap positioned to contact articles adjacent the second side panel, at least a portion of the first reinforcing side flap is free from contact with the first side panel and at least a portion of the second reinforcing side flap is free from contact with the second side panel.

2. The carton of claim 1 wherein the first top flap is foldably connected to the top panel at a first fold line and the first reinforcing end flap is foldably connected to the central panel at a second fold line, the second fold line being spaced apart from and located closer to the interior of the carton than the first fold line.

3. The carton of claim 2 wherein the second top flap is foldably connected to the top panel at a third fold line and the second reinforcing end flap is foldably connected to the central panel at a fourth fold line, the fourth fold line being spaced apart from and located closer to the interior of the carton than the third fold line.

4. The carton of claim 2 further comprising an adhesive flap foldably connected to the top panel and adhesively secured to the second side panel, wherein the adhesive panel is foldably connected to the top panel at a third fold line and the second reinforcing side flap is foldably connected to the central panel at a fourth fold line, the fourth fold line being spaced apart from and located closer to the interior of the carton than the third fold line.

5. The carton of claim 1 wherein the first side panel is foldably connected to the top panel at a first fold line and the first reinforcing side flap is foldably connected to the central panel at a second fold line, the second fold line being spaced apart from and located closer to the interior of the carton than the first fold line.

6. The carton of claim 1 wherein the at least one of the first reinforcing side flaps has a maximum length less than a maximum length of the central panel.

7. A carton for containing a plurality of articles, the carton comprising:

a plurality of panels that extends at least partially around an interior of the carton, the plurality of panels comprises a top panel, a bottom panel, a first side panel, and a second side panel;

a first top end flap foldably connected to a first end of the top panel and a second top end flap foldably connected to a second end of the top panel, wherein the first top end flap at least partially closes a first end of the carton, and the second top end flap at least partially closes a second end of the carton;

a reinforcing insert comprising a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central panel; and an article restraining structure comprising the first reinforcing end flap positioned to contact articles adjacent the first end, the second reinforcing end flap positioned to contact articles adjacent the second end, the first reinforcing side flap positioned to contact articles adjacent the first side panel, and the second reinforcing side flap positioned to contact articles adjacent the second side panel, wherein at least a portion of the first reinforcing end flap is free from contact with the first top end flap and at least a portion of the second reinforcing end flap is free from contact with the second top end flap.

8. A carton for containing a plurality of articles, the carton comprising:

a plurality of panels that extends at least partially around an interior of the carton, the plurality of panels comprises a top panel, a bottom panel, a first side panel and a second side panel;

a first top end flap foldably connected to a first end of the top panel and a second top end flap foldably connected to a second end of the top panel, wherein the first top end flap at least partially closes a first end of the carton, and the second top end flap at least partially closes a second end of the carton;

a reinforcing insert comprising a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central panel; and an article restraining structure comprising the first reinforcing end flap positioned to contact articles adjacent the first end, the second reinforcing end flap positioned to contact articles adjacent the second end, the first reinforcing side flap positioned to contact articles adjacent the first side panel, and the second reinforcing side flap positioned to contact articles adjacent the second side panel, the carton comprising a handle for grasping and carrying the carton, at least one of the first reinforcing side flap and the second reinforcing side flap comprising a handle reinforcing portion and an article restraining portion.

9. The carton of claim 8 wherein the handle reinforcement portion is detachably connected to the article restraining portion.

10. The carton of claim 9 wherein the handle comprises two handle flaps in the top panel, the central portion comprises two handle openings each aligned with a respective handle flap, and the handle reinforcement portion is in face-to-face contact with the central panel and is positioned between the two handle openings.

11. The carton of claim 9 wherein the handle reinforcement portion is detachably connected to the article restraining portion at a tear line.

12. The carton of claim 11 wherein the tear line comprises a straight cut line and a series of spaced-apart nicks comprising a portion of material extending across the cut line that must be torn to separate the handle reinforcement portion form the article restraining portion.

13. The carton of claim 11 wherein the tear line comprises as series of V-shaped cuts and at least one nick comprising a portion of material extending across each of the V-shaped cuts that must be torn to separate the handle reinforcement portion form the article restraining portion.

14. A carton for containing a plurality of articles, the carton comprising:

a plurality of panels that extends at least partially around an interior of the carton, the plurality of panels comprises a top panel, a bottom panel, a first side panel, and a second side panel;

a first top end flap foldably connected to a first end of the top panel and a second top end flap foldably connected to a second end of the top panel, wherein the first top end flap at least partially closes a first end of the carton, and the second top end flap at least partially closes a second end of the carton;

a reinforcing insert comprising a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central panel; and an article restraining structure comprising the first reinforcing end flap positioned to contact articles adjacent the first end, the second reinforcing end flap positioned to contact articles adjacent the second end, the first reinforcing side flap positioned to contact articles adjacent the first side panel, and the second reinforcing side flap positioned to contact articles adjacent the second side panel, wherein at least one of the first reinforcing side flap and the second reinforcing side flap comprises three independently moveable portions.

15. A carton for containing a plurality of articles, the carton comprising:

a plurality of panels that extends at least partially around an interior of the carton, the plurality of panels comprises a top panel, a bottom panel, a first side panel, and a second side panel;

a first top end flap foldably connected to a first end of the top panel and a second top end flap foldably connected to a second end of the top panel, wherein the first top end flap at least partially closes a first end of the carton, and the second top end flap at least partially closes a second end of the carton;

a reinforcing insert comprising a central panel, a first reinforcing side flap foldably connected to the central panel at a first side of the central panel, a second reinforcing side flap foldably connected to the central panel at a second side of the central panel a first reinforcing end flap foldably connected to the central panel at a first end of the central panel, and a second reinforcing end flap foldably connected to the central panel at a second end of the central panel;

an article restraining structure comprising the first reinforcing end flap positioned to contact articles adjacent the first end, the second reinforcing end flap positioned to contact articles adjacent the second end, the first reinforcing side flap positioned to contact articles adjacent the first side panel, and the second reinforcing side flap positioned to contact articles adjacent the second side panel; and a handle in the top panel comprising at least one handle flap in the top panel, the central portion comprises at least one handle opening aligned with the at least one handle flap, and at least one of the first reinforcing side flap and the second reinforcing side flap comprises a retention tab, the retention tab is positioned to be received in the at least one handle opening.

16. In combination, a carton blank and an insert blank for forming a carton having article restraining features for retraining movement of articles in the carton, the carton blank comprising:

a plurality of panels comprising a top panel, a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the carton blank and the insert blank, and the second top end flap if for at least partially closing a second end of the carton formed from the carton blank and the insert blank;

the insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

wherein article restraining features comprises the first reinforcing end flap that is for being positioned to contact articles adjacent the first end in the carton formed from the carton blank and the insert blank, the second reinforcing end flap that is for being positioned to contact articles adjacent the second end in the carton formed from the carton blank and the insert blank, the first reinforcing side flap that is for being positioned to contact articles adjacent the first side panel in the carton formed from the carton blank and the insert blank, and the second reinforcing side flap that is for being positioned to contact articles adjacent the second side pane in the carton formed from the carton blank and the insert blank, and at least a portion of the first reinforcing side flap is free from contact with the first side panel and at least a portion of the second reinforcing side flap is free from contact with the second side panel.

17. The combination of claim 16 wherein the first top flap is foldably connected to the top panel at a first fold line and the first reinforcing end flap is foldably connected to the central panel at a second fold line, the second fold line being spaced apart from and located closer to a centerline of the carton blank than the first fold line.

18. The combination of claim 17 wherein the second top flap is foldably connected to the top panel at a third fold line and the second reinforcing end flap is foldably connected to the central panel at a fourth fold line, the fourth fold line being spaced apart from and located closer to a centerline of the carton blank than the third fold line.

19. The combination of claim 17 further comprising an adhesive flap foldably connected to the top panel and adhesively secured to the second side panel, wherein the adhesive panel is foldably connected to the top panel at a third fold line and the second reinforcing side flap is foldably connected to the central panel at a fourth fold line, the fourth fold line being spaced apart from and located closer to the interior of the carton than the third fold line.

20. The combination of claim 16 wherein the first side panel is foldably connected to the top panel at a first fold line and the first reinforcing side flap is foldably connected to the central panel at a second fold line, the second fold line being spaced apart from and located closer to a centerline of the carton blank than the first fold line.

21. The combination of claim 16 wherein the at least one of the first reinforcing side flaps has a maximum length less than a maximum length of the central panel.

22. In combination, a carton blank and an insert blank for forming a carton having article restraining features for retraining movement of articles in the carton, the carton blank comprising:

a plurality of panels comprising a top panel, a bottom panel, a first side panel, and a second side panel, a first top end flap foldably connected to a first end of the top panel and a second top end flap foldably connected to a second end of the top panel, wherein the first top end flap is for at least partially closing a first end of the carton formed from the carton blank and the insert blank, and the second top end flap if for at least partially closing a second end of the carton formed from the carton blank and the insert blank;

the insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

wherein article restraining features comprises the first reinforcing end flap that is for being positioned to contact articles adjacent the first end in the carton formed from the carton blank and the insert blank, the second reinforcing end flap that is for being positioned to contact articles adjacent the second end in the carton formed from the carton blank and the insert blank, the first reinforcing side flap that is for being positioned to contact articles adjacent the first side panel in the carton formed from the carton blank and the insert blank, and the second reinforcing side flap that is for being positioned to contact articles adjacent the second side pane in the carton formed from the carton blank and the insert blank, and at least a portion of the first reinforcing end flap is free from contact with the first top end flap and at least a portion of the second reinforcing end flap is free from contact with the second top end flap.

23. In combination, a carton blank and an insert blank for forming a carton having article restraining features for retraining movement of articles in the carton, the carton blank comprising:

a plurality of panels comprising a top panel, a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the carton blank and the insert blank, and the second top end flap if for at least partially closing a second end of the carton formed from the carton blank and the insert blank;

the insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

wherein article restraining features comprises the first reinforcing end flap that is for being positioned to contact articles adjacent the first end in the carton formed from the carton blank and the insert blank, the second reinforcing end flap that is for being positioned to contact articles adjacent the second end in the carton formed from the carton blank and the insert blank, the first reinforcing side flap that is for being positioned to contact articles adjacent the first side panel in the carton formed from the carton blank and the insert blank, and the second reinforcing side flap that is for being positioned to contact articles adjacent the second side pane in the carton formed from the carton blank and the insert blank, further comprising handle features for forming a handle in the carton formed from the carton blank and the insert blank, and at least one of the first reinforcing side flap and the second reinforcing side flap comprising a handle reinforcing portion and an article restraining portion.

24. The combination of claim 23 wherein the handle reinforcement portion is detachably connected to the article restraining portion.

25. The combination of claim 24 wherein the handle features comprise two handle flaps in the top panel, two handle openings in the central portion each being aligned with a respective handle flap, and the handle reinforcement portion is in face-to-face contact with the central panel and is positioned between the two handle openings.

26. The combination of claim 24 wherein the handle reinforcement portion is detachably connected to the article restraining portion at a tear line.

27. The combination of claim 26 wherein the tear line comprises a straight cut line and a series of spaced-apart nicks comprising a portion of material extending across the cut line that must be torn to separate the handle reinforcement portion form the article restraining portion.

28. The combination of claim 26 wherein the tear line comprises as series of V-shaped cuts and at least one nick comprising a portion of material extending across each of the V-shaped cuts that must be torn to separate the handle reinforcement portion form the article restraining portion.

29. In combination, a carton blank and an insert blank for forming a carton having article restraining features for retraining movement of articles in the carton, the carton blank comprising:

a plurality of panels comprising a top panel a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the carton blank and the insert blank, and the second top end flap if for at least partially closing a second end of the carton formed from the carton blank and the insert blank;

the insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

wherein article restraining features comprises the first reinforcing end flap that is for being positioned to contact articles adjacent the first end in the carton formed from the carton blank and the insert blank, the second reinforcing end flap that is for being positioned to contact articles adjacent the second end in the carton formed from the carton blank and the insert blank, the first reinforcing side flap that is for being positioned to contact articles adjacent the first side panel in the carton formed from the carton blank and the insert blank, and the second reinforcing side flap that is for being positioned to contact articles adjacent the second side pane in the carton formed from the carton blank and the insert blank, and at least one of the first reinforcing side flap and the second reinforcing side flap comprises three independently moveable portions.

30. In combination, a carton blank and an insert blank for forming a carton having article restraining features for retraining movement of articles in the carton, the carton blank comprising:

a plurality of panels comprising a top panel, a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the carton blank and the insert blank, and the second top end flap if for at least partially closing a second end of the carton formed from the carton blank and the insert blank;

the insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

wherein article restraining features comprises the first reinforcing end flap that is for being positioned to contact articles adjacent the first end in the carton formed from the carton blank and the insert blank, the second reinforcing end flap that is for being positioned to contact articles adjacent the second end in the carton formed from the carton blank and the insert blank, the first reinforcing side flap that is for being positioned to contact articles adjacent the first side panel in the carton formed from the carton blank and the insert blank, and the second reinforcing side flap that is for being positioned to contact articles adjacent the second side pane in the carton formed from the carton blank and the insert blank, and further comprising handle features comprising at least one handle flap in the top panel and at least one handle opening in the central portion aligned with the at least one handle flap, and at least one of the first reinforcing side flap and the second reinforcing side flap comprises a retention tab, the retention tab is positioned to be received in the at least one handle opening.

31. A method of forming a carton comprising:

obtaining a carton blank comprising:

a plurality of panels comprising a top panel, a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the blank, and the second top end flap if for at least partially closing a second end of the carton formed from the carton blank and the insert blank;

obtaining an insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

positioning the insert blank relative to the carton blank so that the central panel overlaps at least a portion of the top panel; and forming an article restraining structure comprising the first reinforcing end flap, the second reinforcing end flap, the first reinforcing side flap, and the second reinforcing side flap, the forming the article restraining structure comprises positioning the first reinforcing end flap for contact with articles adjacent the first end in the carton, positioning the second reinforcing end flap for contact with articles adjacent the second end in the carton, positioning the first reinforcing side flap for contact with articles adjacent the first side panel, positioning the second reinforcing side flap for contact with articles adjacent the second side panel, positioning the first reinforcing side flap so that at least a portion of the first reinforcing side flap is free from contact with the first side panel, and positioning the second reinforcing side flap so at least a portion of the second reinforcing side flap is free from contact with the second side panel;

attaching the insert blank to the carton blank; and forming the attached insert blank and carton blank into a carton.

32. The method of claim 31 wherein the carton blank further comprises an adhesive flap foldably connected to the top panel and the forming the attached insert blank and carton blank into a carton comprises adhesively securing the adhesive flap to the second side panel to form an open-ended sleeve.

33. The method of claim 31 wherein the carton blank comprises handle features comprising at least one handle flap in the top panel and at least one handle opening in the central portion aligned with the at least one handle flap, and at least one of the first reinforcing side flap and the second reinforcing side flap comprises a retention tab, the forming the restraining structure comprises positioning the retention tab in the at least one handle opening.

34. A method of forming a carton comprising:

obtaining a carton blank comprising:

a plurality of panels comprising a top panel, a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the blank, and the second top end flap if for at least partially closing a second end of the carton formed from the carton blank and the insert blank;

obtaining an insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel, and a second reinforcing end flap foldably connected to the central panel at a second end of the central;

positioning the insert blank relative to the carton blank so that the central panel overlaps at least a portion of the top panel; and forming an article restraining structure comprising the first reinforcing end flap, the second reinforcing end flap, the first reinforcing side flap, and the second reinforcing side flap, the forming the article restraining structure comprises positioning the first reinforcing end flap for contact with articles adjacent the first end in the carton, positioning the second reinforcing end flap for contact with articles adjacent the second end in the carton, positioning the first reinforcing side flap for contact with articles adjacent the first side panel, positioning the second reinforcing side flap for contact with articles adjacent the second side panel, positioning the first reinforcing end flap so that at least a portion of the firs reinforcing end flap is free from contact with the first top end flap, and positioning the second reinforcing end flap so at least a portion of the second reinforcing end flap is free from contact with the second top end flap;

attaching the insert blank to the carton blank; and forming the attached insert blank and carton blank into a carton.

35. A method of forming a carton comprising:

obtaining a carton blank comprising:

a plurality of panels comprising a top panel, a bottom panel, a first side panel, and a second side panel;

a first top end flap foldably connected to a first end of the top panel and a second top end flap foldably connected to a second end of the top panel, wherein the first top end flap is for at least partially closing a first end of the carton formed from the blank, and the second top end flap if for at least partially closing a second end of the carton formed from the carton blank and the insert blank;

obtaining an insert blank comprising:

a central panel, a first reinforcing side flap foldably connected to the central panel at a first side of the central panel, a second reinforcing side flap foldably connected to the central panel at a second side of the central panel, a first reinforcing end flap foldably connected to the central panel at a first end of the central panel and a second reinforcing end flap foldably connected to the central panel at a second end of the central;

positioning the insert blank relative to the carton blank so that the central panel overlaps at least a portion of the top panel; and forming an article restraining structure comprising the first reinforcing end flap, the second reinforcing end flap, the first reinforcing side flap, and the second reinforcing side flap, the forming the article restraining structure comprises positioning the first reinforcing end flap for contact with articles adjacent the first end in the carton, positioning the second reinforcing end flap for contact with articles adjacent the second end in the carton, positioning the first reinforcing side flap for contact with articles adjacent the first side panel, positioning the second reinforcing side flap for contact with articles adjacent the second side panel;

attaching the insert blank to the carton blank; and forming the attached insert blank and carton blank into a carton, wherein the carton blank further comprises handle features for forming a handle in the carton formed from the carton blank and the insert blank, and at least one of the first reinforcing side flap and the second reinforcing side flap comprises a handle reinforcing portion and an article restraining portion, the forming the article restraining structure comprises separating the article restraining portion from the handle reinforcement portion.

36. The method of claim 35 wherein the handle features comprise two handle flaps in the top panel, the positioning the insert blank relative to the carton blank comprises aligning a respective one of the two handle openings in the central portion with a respective handle flap, and the forming the article restraining structure comprises positioning the handle reinforcement structure between the two handle openings and securing the handle reinforcement portion in face-to-face contact with the central panel.

* * * * *